US006640836B1

(12) United States Patent
Haubert et al.

(10) Patent No.: US 6,640,836 B1
(45) Date of Patent: Nov. 4, 2003

(54) COIL AND COIL HEAD FORMATION DIES FOR COILS WITH NON-CONVENTIONAL TERMINAL CONVOLUTIONS

(75) Inventors: Thomas D. Haubert, Columbus, OH (US); Jan B. Yates, Reynoldsburg, OH (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 09/723,668

(22) Filed: Nov. 28, 2000

Related U.S. Application Data

(63) Continuation-in-part of application No. 09/151,872, filed on Sep. 11, 1998, now Pat. No. 6,155,310.

(51) Int. Cl.[7] ..... B21F 3/10
(52) U.S. Cl. ..... 140/3 CA; 72/138
(58) Field of Search ..... 72/137, 138, 145; 140/3 CA, 103, 101

(56) References Cited

U.S. PATENT DOCUMENTS 3,541,827 A * 11/1970 Hansen ..... 72/138
5,444,905 A * 8/1995 St. Clair ..... 140/3 CA

* cited by examiner

*Primary Examiner*—Lowell A. Larson
(74) *Attorney, Agent, or Firm*—Roetzel & Andress

(57) ABSTRACT

Machinery for automated manufacture of formed wire structures such as innerspring assemblies for mattresses and seating and flexible support structures includes one or more coil formation devices configured to produce generally helical spring coils having a terminal convolution which extends beyond an end of the coil; a conveyor system having a plurality of flights slidably mounted upon a continuous track and connected to a chain and driven by an index driver; a coil transfer machine which removes a row of coils from the conveyor and inserts the coils into an innerspring assembler; and an innerspring assembler. A coil forming block on a coiler machine has a cavity in which a terminal convolution of the coil is formed, and from which the coil is cut by a cutter which extends into the cavity. Coil head formation dies at coil head forming stations of the coil forming machine also have a cavity for receiving a terminal convolution of a coil, and flanges which surround the cavity and provide a punch set for punches which form a coil head proximate to the terminal convolution in the die.

35 Claims, 35 Drawing Sheets

COIL AND COIL HEAD FORMATION DIES FOR COILS WITH NON-CONVENTIONAL TERMINAL CONVOLUTIONS

This application is a continuation-in-part of application Ser. No. 09/151,872 filed Sep. 11, 1998 now U.S. Pat. No. 6,155,310.

FIELD OF THE INVENTION

The present invention pertains generally to formed wire structures and, more particularly, to machinery for automated manufacture and assembly of wire form structures such as coils and springs, and innerspring assemblies having an array of interconnected wire springs or coils.

BACKGROUND OF THE INVENTION

Innerspring assemblies, for mattresses, furniture, seating and other resilient structures, were first assembled by hand by arranging coils or springs in a matrix and interconnecting them with lacing or tying wires. The coils are connected at various points along the axial length, according to the innerspring design. Machines which automatically form coils have been mated with various conveyances which deliver coils to an assembly point. For example, U.S. Pat. Nos. 3,386,561 and 4,413,659 describe apparatus which feeds springs from an automated spring former to a spring core assembly machine. The spring or coil former component is configured to produce a particular coil design. Coils are produced from steel wire stock which is fed through a die and bent or coiled at designed radiuses by cam-controlled forming guides. Following the helical formation of the coil in this manner, the heads or end turns of the coils may be secondarily formed by punch dies. Most coil designs terminate at each end with one or more turns in a single plane. This simplifies automated handling of the coils, such as conveyance to an assembler and passage through the assembler. Coil forming machinery of the prior art is not configured or easily adapted to produce coils of alternate configurations, such as coils which do not terminate in a single plane.

The timed conveyance of coils from the former to the assembler is always problematic. Automated production is interrupted if even a single coil is misaligned in the conveyor. The conveyor drive mechanism must be perfectly timed with operation of the coil former and a transfer machine which picks up an entire row of coils from a conveyor and loads it into the innerspring assembler.

The spring core assembly component of the prior art machines is typically set up to accommodate one particular type of spring or coil. The coils are held within the machine with the base or top of the coil fit over dies or held by clamping jaws, and tied or laced together by a helical wire or fastening rings. This approach is limited to use with coils of particular configurations which fit over the dies and within the helical lacing and knuckling shoes. Such machines are not adaptable to use with different coil designs, particularly coils with a terminal convolution which extends beyond a base or end of the coil. Also, these types of machines are prone to malfunction due to the fact that two sets of clamping jaws, having multiple small parts and linkages moving at a rapid pace, are required for the top and bottom of each coil.

SUMMARY OF INVENTION

The present invention overcomes these and other disadvantages of the prior art by providing novel machinery for complete automated manufacture of formed wire innerspring assemblies from wire stock. In accordance with one particular aspect of the invention, there is provided: a coil formation device for forming coils having a generally helical coil body, a non-helical coil head, and a terminal convolution generally smaller than the coil body, the coil formation device having a wire feed mechanism which feeds wire stock into a coil forming block, the coil forming block having a cavity within which a terminal convolution of the coil is formed, a coil radius forming wheel against which wire stock bears to form a generally helical shape to the coil body, a helical guide pin in contact with the wire stock and operative to move relative to the forming block to form a generally helical shape to the coil body, a wire cutting tool configured to cut the wire stock within the cavity of the coil forming block, a geneva for transferring a coil from the coil forming block to a coil head forming station, the coil head forming station having a coil head formation die, the coil head formation die having a cavity configured to receive a terminal convolution of the coil, and a flange proximate to the cavity about which an end turn of the coil body is positioned by the geneva, and at least one punch operative to strike the end turn of the coil body against the flange of the coil head formation die to form a coil head between the coil body and the terminal convolution.

In accordance with another particular aspect of the invention, there is provided: a coil head formation die for use with a coil forming machine for forming a coil head in an end turn of a body of a coil having a terminal convolution contiguous with a body of the coil, the coil head formed by operation of one or more punches of the coil forming machine operative to strike a portion of the end turn of the coil against the die while the end turn of the coil and the terminal convolution of the coil are engaged with the coil head formation die, the coil head formation die having a cavity configured to receive a terminal convolution of the coil, and a portion configured to oppose a punch which strikes the end turn of the coil to form a coil head.

And in another aspect of the invention, there is provided: an automated innerspring assembly system for producing innerspring assemblies having a plurality of wire form coils interconnected in an array, the automated innerspring assembly system having at least one coil formation device operative to form wire stock into individual coils configured for assembly in an innerspring assembly, and operative to deliver individual coils to a coil conveyor, a coil conveyor associated with the coil formation device and operative to receive coils from the coil formation device and convey coils to a coil transfer machine, a coil transfer machine operative to remove coils from the coil conveyor and present coils to an innerspring assembler, an innerspring assembler operative to receive and engage a plurality of coils arranged in a row, to position a received row of coils parallel and closely adjacent to a previously received row of coils, to fixedly compress two adjacent rows of coils in a fixed position and interconnect the adjacent rows of coils with fastening means, and to advance interconnected rows of coils out of the assembler and receive and engage a subsequent row of coils, and repeat the process until an entire innerspring assembly is formed.

These and other aspects of the invention are herein described in particularized detail with reference to the accompanying Figures.

BRIEF DESCRIPTION OF THE FIGURES

In the accompanying Figures:

FIGS. 7A–7I are schematic diagrams of coils, coil-receiving dies, and die support pieces as arranged and moved within the innerspring assembly machine of FIG. 5;

DETAILED DESCRIPTION OF PREFERRED AND ALTERNATE EMBODIMENTS

Figure 12:
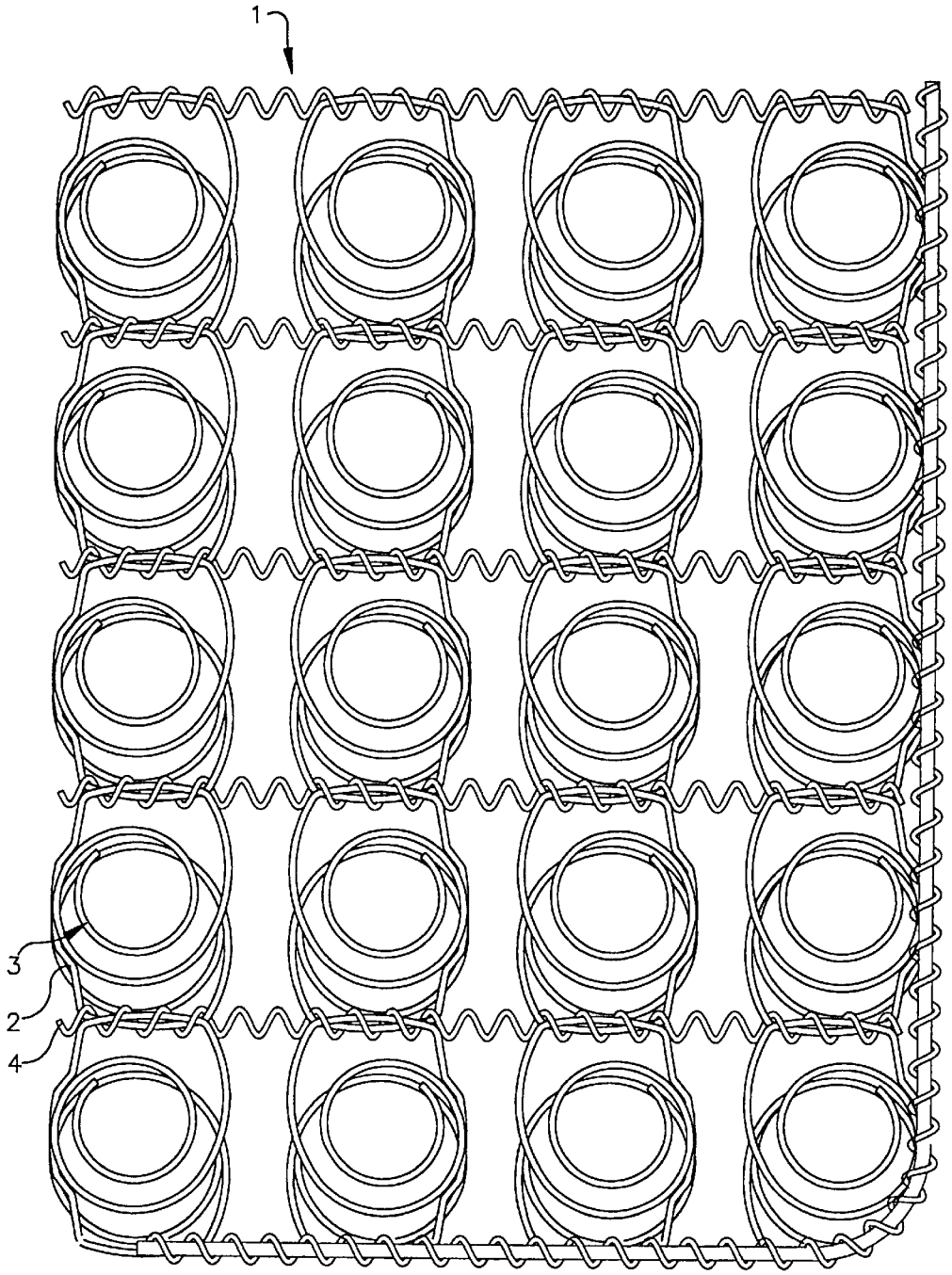
FIG. 12 is a partial plan view of an innerspring assembly producible by the machinery of the present invention.
Figure 13:
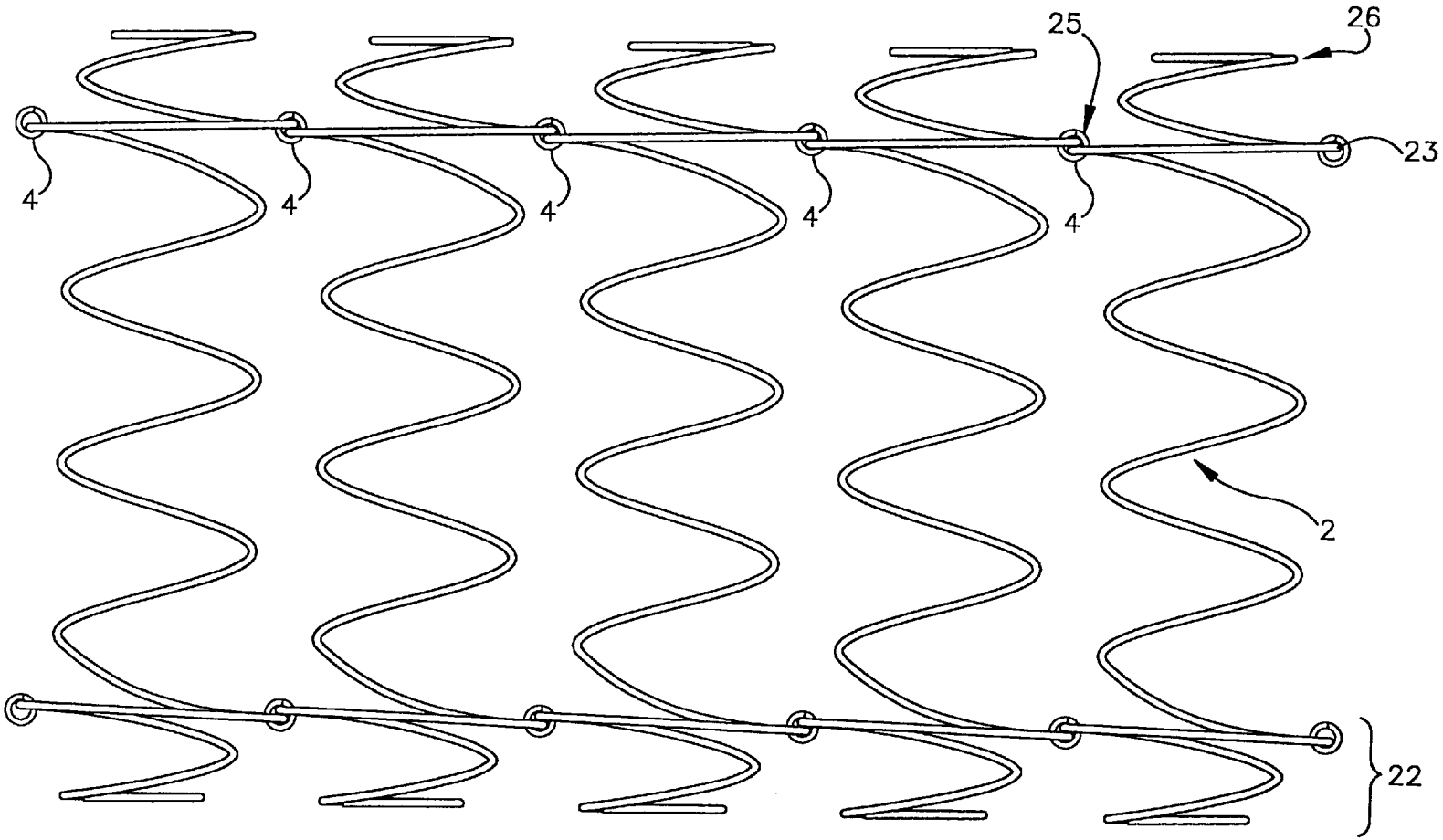
FIG. 13 is a partial elevational view of the innerspring assembly of FIG. 12.

The described machinery and methods can be employed to produce innerspring assemblies 1, including mattress or furniture or seating innerspring assemblies, in a general form as depicted in FIGS. 12 and 13. The innerspring assembly 1 includes a plurality of springs or coils 2 in an array such as an orthogonal array, with axes of the coils generally parallel and ends 3 of the coils generally co-planar, defining resilient support surfaces of the innerspring assembly 1. The coils 2 are "laced" or wirebound together in the array by, for example, generally helical lacing wires 4 which run between rows of the coils and which wrap or lace around tangential or overlapping segments of adjacent coils as shown in FIG. 13. Other means of coil fastening can be employed within the scope of the invention.

The coils formed by the coil formation components of the machinery may be of any configuration or shape formable from steel wire stock. Typically, innerspring coils have an elongated coil body with a generally helical configuration, terminating at the ends with one or more turns of the wire in a plane which forms a load-bearing head. Other coil forms and innerspring assemblies not expressly shown are nonetheless producible by the described machinery and are within the scope of the invention.

Figure 14A:
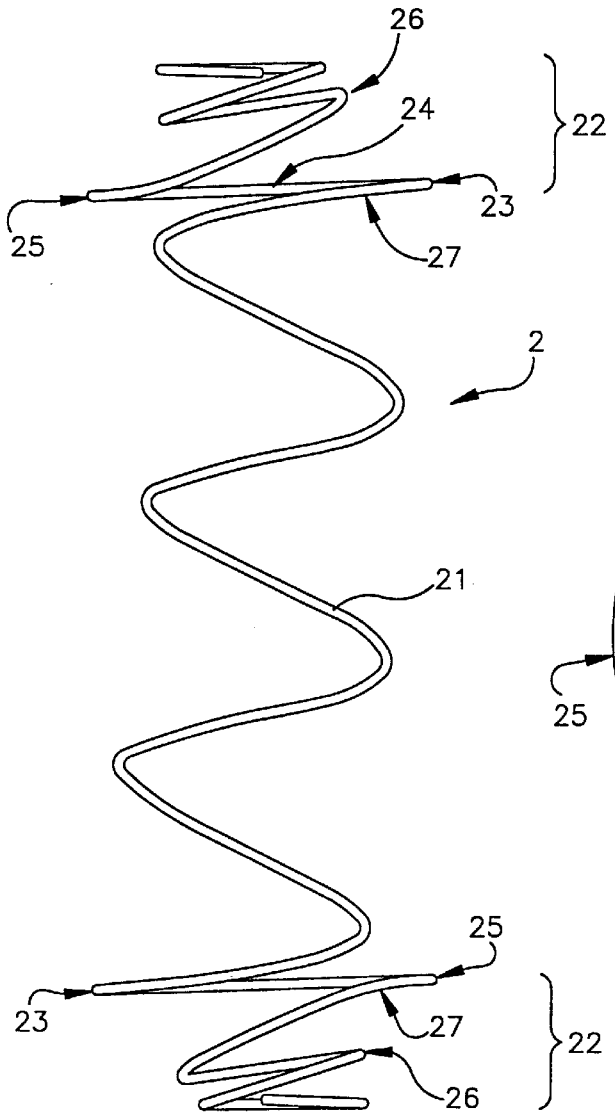
FIG. 14A is a profile view of a coil of the innerspring assembly of FIG. 12.
Figure 14B:
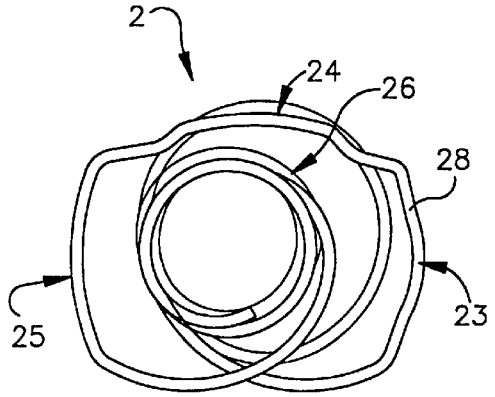
FIG. 14B is an end view of a coil of the innerspring assembly of FIG. 12.

The following machinery and method descriptions are made with reference to a particular mattress innerspring with a particular type of coil 2 shown in isolation in FIGS. 14A and 14B. An example of this type of coil is described and claimed in U.S. Pat. No. 5,013,088. The coil 2 has a generally helical elongate coil body 21 which terminates at each end with a head 22. Each head 22 includes a first offset 23, second offset 24, and third offset 25 A generally helical terminal convolution 26 extends from the third offset 25 axially beyond the head. A force responsive gradient arm 27 may be formed in a segment of the helical body 21 leading or transitioning to the coil head 22.

As shown in FIG. 14B, the first offset 23 may include a crown 28 which positions the offset a slightly greater distance laterally from the longitudinal axis of the coil. The second and third offsets 24 and 25 are also outwardly offset from the longitudinal axis of the coil. As shown in FIG. 13, the first and third offsets 23 and 25 of each coil overlap the offsets of adjacent coils and are laced together by the helical lacing wires 4, and the terminal convolutions 26 extend beyond (above and below) the points of laced attachment of the coil head offsets.

Figure 1:
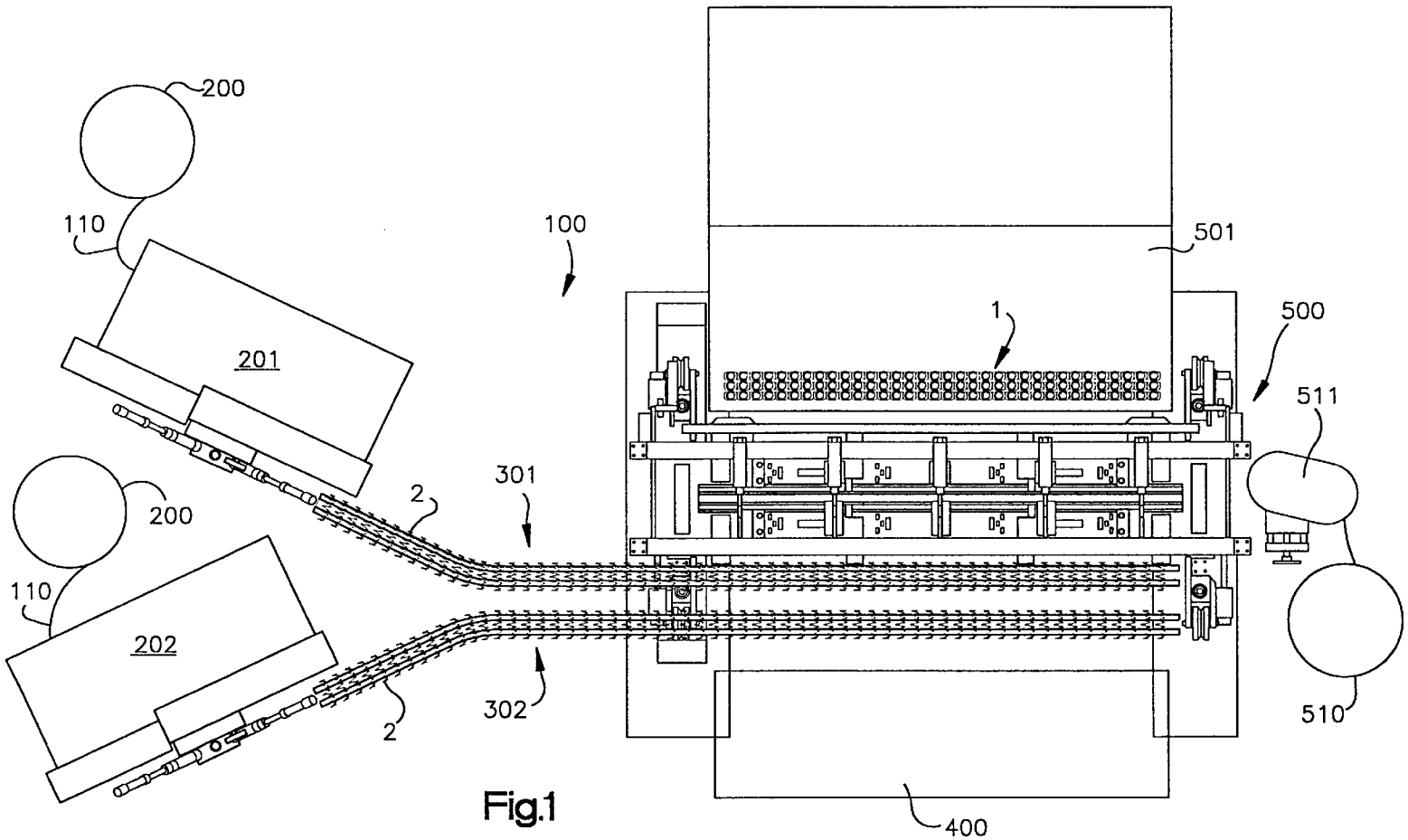
FIG. 1 is a plan view of the machinery for automated manufacture of formed wire innerspring assemblies of the present invention.

FIG. 1 illustrates the main components of the automated innerspring manufacturing system 100 of the invention. Coil wire stock 110 is fed from a spool 200 to one or more coil former machines 201, 202 which produce coils such as shown in FIGS. 14A, 14B or any other types of generally helical coils or other distinct wire form structures. The coils 2 are loaded into one or more coil conveyors 301, 302 which convey coils to a coil transfer machine 400. The coil transfer machine 400 loads a plurality of coils into an innerspring assembly machine 500 which automatically assembles coils into the described innerspring array by attachment with, for example, a helical wire formed from lacing wire stock 510 spool-fed to the assembler through a helical wire former and feeder 511, also referred to as a coil interconnection device.

Each of the main components of the system 100 are now described individually, followed by a description of the system operation and the resulting wire form structure innerspring assembly. Although described with specific reference to the automated formation and assembly of a particular innerspring, it will be appreciated that the various components of the invention can be employed to produce any type of wire form structure.

Coil Formation

The coil formers 201, 202 may be, for example, a known wire formation machine or coiler, such as a Spuhl LFK coiler manufactured by Spuhl AG of St. Gallen, Switzerland. As shown schematically in FIG. 2, the coil formers 201, 202 feed wire stock 110 through a series of rollers and wire-formers to bend the wire into the designed coil formation. The radius of curvature in the helical segments of the coils is determined by the shapes of cams (not shown) in rolling contact with a cam follower arm 204. The coil wire stock 110 is fed to the coiler by feed rollers 206 into a forming block or die 208. As the wire is advanced through a guide hole or exit point 2081 in the die 208, it contacts a coil radius forming wheel 210, attached to an end of the cam follower arm 204. The forming wheel 210 is moved relative to the forming block 208, toward and away from the line of feed of the wire stock 110, by travel distances defined by rotating cams which the arm 204 follows. In this manner, the radius of curvature of the helix of the coil is formed as the wire emerges from the forming block against the forming wheel.

A helix is formed in the wire stock after it passes the forming wheel 210 by a helix guide pin 214 which moves in a generally linear path, generally perpendicular to the wire stock guide hole 2081 in the forming block 208, in order to advance the wire in a helical path away from the forming wheel 210. Once a sufficient amount of wire has been fed through the forming block 208, past the forming wheel 210 and the helix guide pin 214, to form a complete coil, a cutting tool 212 is advanced against the forming block 208 to sever the coil from the wire stock. The severed coil is then advanced by a geneva 220 to subsequent formation and processing stations as further described below.

As shown in FIG. 14B, the coil 2 has several different radii of curvature in the helical coil body. In particular, the radius or total diameter of the terminal convolution 26 is significantly less than that of the main coil body 21. Furthermore, the wire terminates and must be severed at the very end of the terminal convolution 26. This particular coil structure presents a problem with respect to the forming block 208 which must be specifically configured to accommodate the terminal convolution 26, allow the larger diameter coil body to advance over the forming block, and allow the cutting tool 212 to cut the wire at the very end of the terminal convolution.

Figure 2:
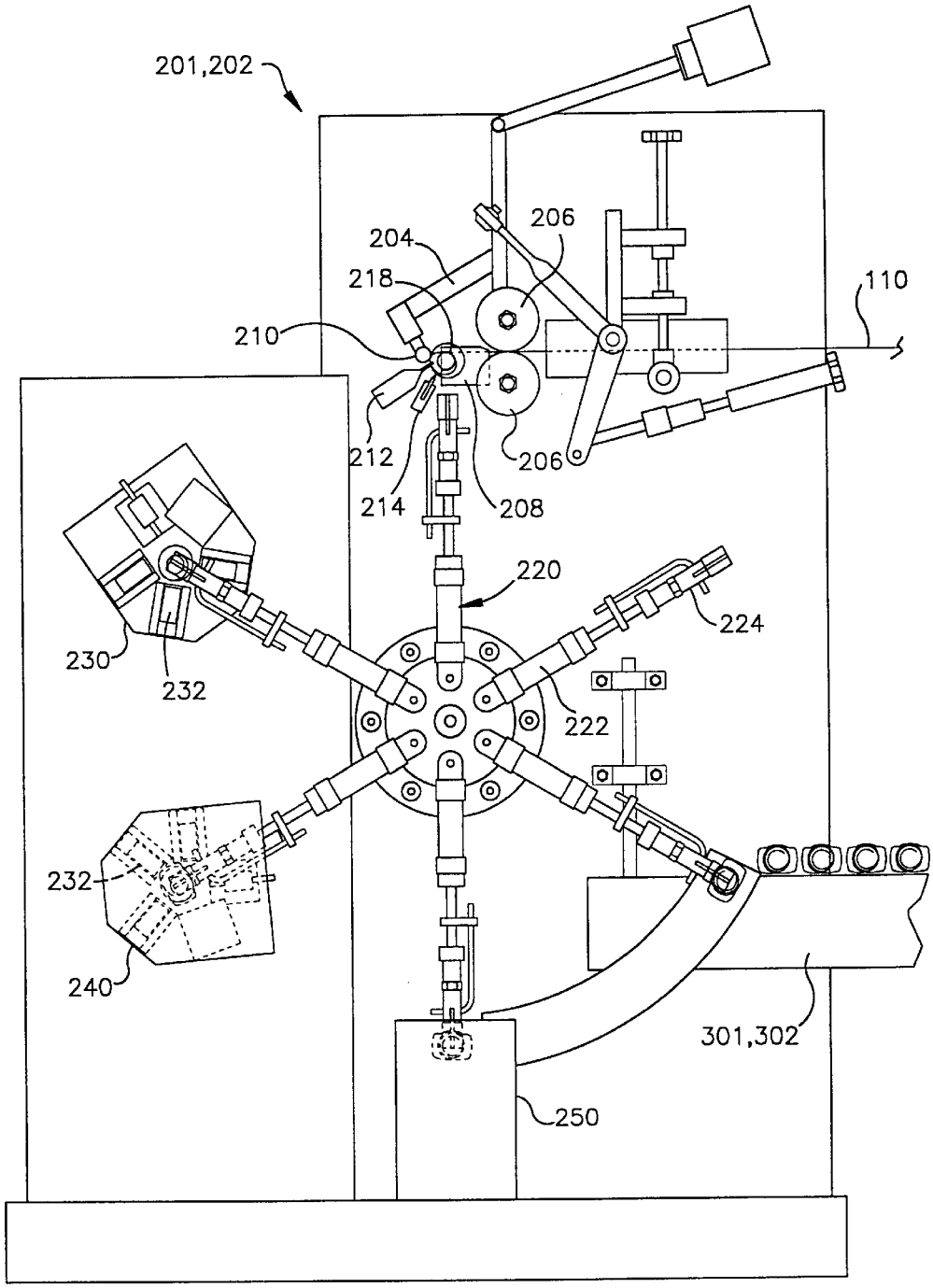
FIG. 2 is an elevational view of a coil former machine of the present invention.
Figure 20:
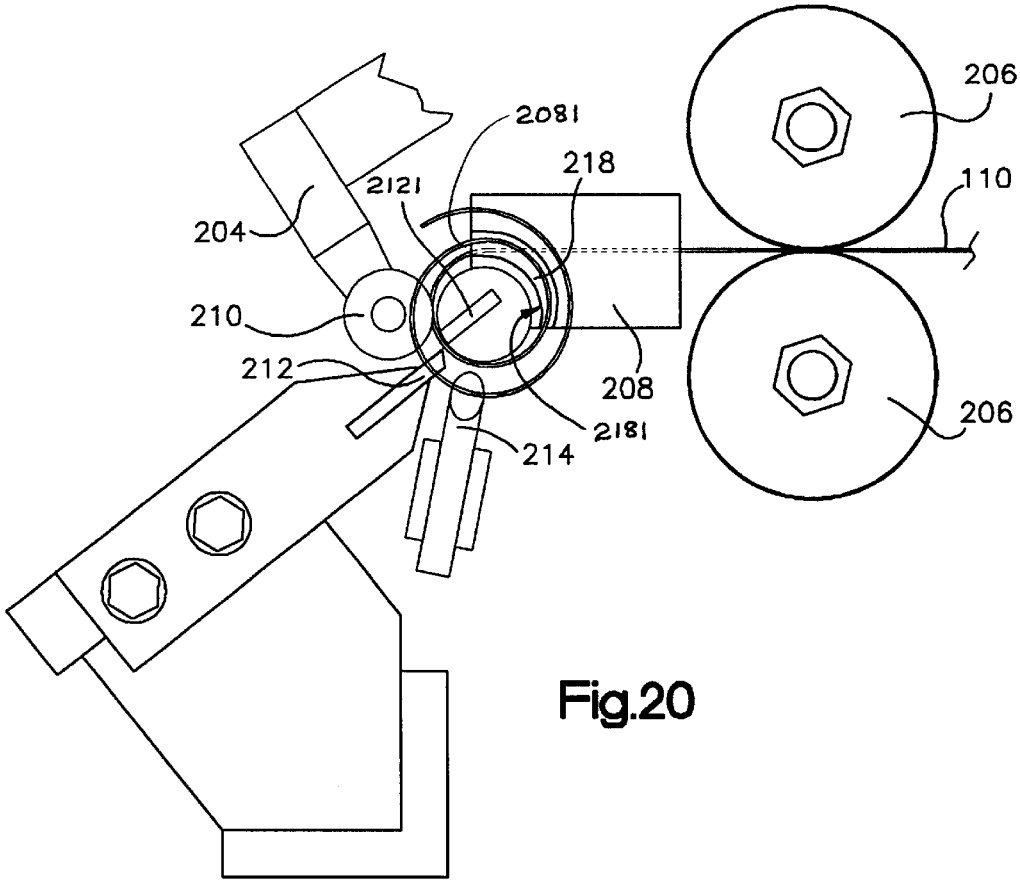
FIG. 20 is a partial frontal view of a coil formation station of a coil forming machine of the present invention.
Figure 21:
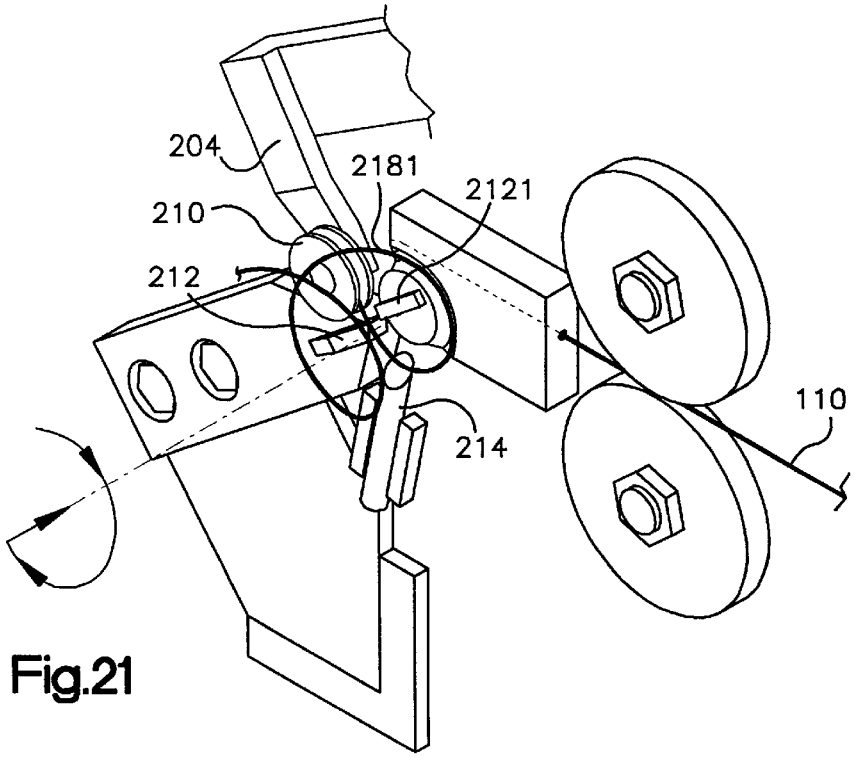
FIG. 21 is a perspective view of a coil formation station of a coil forming machine of the present invention.
Figure 24:
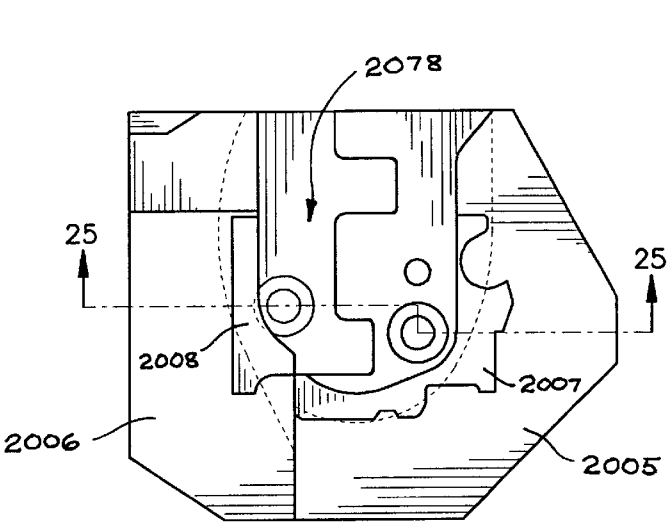
FIGS. 24 and 25 are plan and elevation views of a coil head formation die of the present invention.
Figure 25:
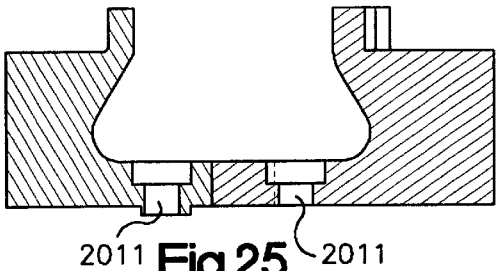
Figure 23:
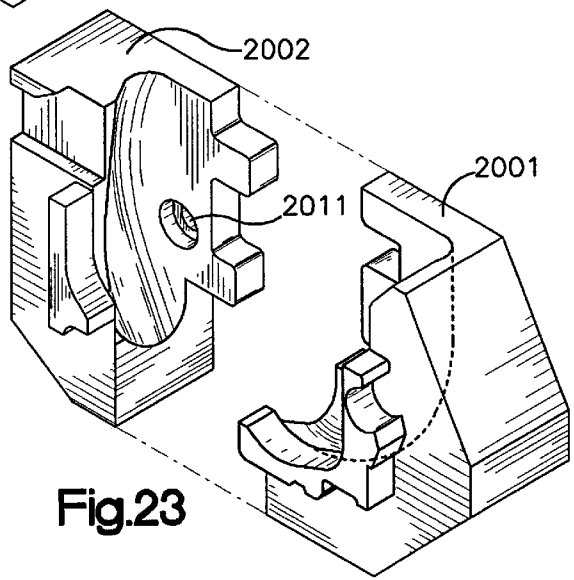
FIGS. 22 and 23 are perspective views of a coil head formation die of the present invention.

As shown in FIG. 2, and in FIGS. 20 and 21, the forming block 208 of the invention includes a cavity 218 dimensioned to receive a terminal convolution of the coil. The cutting tool 212 is located proximate to the cavity 218 in the forming block 208 to sever the wire at the terminal convolution within cavity 218. The internal walls of cavity 218 are generally arcuate along an interior surface 2181 against which the wire 110 bears as it is radially formed by the forming wheel 210. The surface of the cavity 218 against which the wire stock 110 bears is tapered in a helical configuration. The taper in the cavity 218 is congruent with a helix angle formed in the wire stock 110 by the helical guide pin 214. The helical guide pin 214 is operative to engage wire stock 110 formed within the cavity. A helical-form groove is preferably made in surface 2181 to further guide the helix formation of the terminal convolutions and coil body. The helix guide pin 214 is cam-controlled to move out away from the forming block and cavity 218, to thereby form the differing helical portions of the terminal convolutions 26 and the coil body 21. The termination of the coil wire at the last terminal convolution 26 to form within cavity 218 requires the cutting tool 212 to project into cavity 218 to cut the wire against an opposing cutting blade 2121 mounted within and/or projecting from cavity 218, as shown in FIG. 20.

Referring again to FIG. 2, a geneva 220 with, for example, six geneva arms 222, is rotationally mounted proximate to the front of the coiler. Each geneva arm 222 supports a gripper 224 operative to grip a coil as it is cut from the continuous wire feed at the forming block 208. The geneva rotationally indexes to advance each coil from the coiler guide block to a first coil head forming station 230. Pneumatically operated punch tools 232 are mounted in a radial arrangement about the first coil head forming station 230 to form the coil offsets 23-25, the force responsive gradient arm 27, or any other contours or bends in the coil head or helical turn at one end of the coil body, by striking the wire against a die. The geneva then advances the coil to a second coil head forming station 240 oriented at an opposite end of the coil which similarly forms a coil head by punch tools 232 and corresponding dies.

For making the type of coil 2 described with reference to FIGS. 12–14, a special coil head formation die 2000 is utilized at each coil head forming station 230, 240. As shown in isolation in FIGS. 22–25, the coil head formation die 2000 has interlocking halves 2001, 2002 which when mated form a joint die body 2003 having a back wall 2004 and contoured side sections 2005 and 2006. The projection of the side sections 2005 and 2006 from the back wall 2004 forms a cavity 2010 within the die body 2003. Cavity 2010 is configured to receive the terminal convolution 26 of the coil. Extending outward from the side sections 2005, 2006 are flanges 2007 and 2008. The side walls 2009 of flanges 2007, 2008 are configured according to the shape of the coil head 22 to be formed, so that as the first turn of the coil body 21 is positioned about the perimeter of flanges 2007, 2008 (with the terminal convolution 26 positioned within the die cavity 2010), the punch tools 232 at the coil head forming stations 230, 240 strike the wire against the side walls 2009 of flanges 2007, 2008 to form the coil head 22 in the configuration of the external periphery of the flanges 2007, 2008, e.g. with offset segments 23, 24, 25 shown in FIG. 14B. The combination of the die cavity 2010 and the coil head forming flanges 2007, 2008 enables production of a wide variety of coil designs, including any coil design having different diameters at the terminal ends (i.e., terminal convolutions smaller than the coil body) and any coil head design contiguous with the terminal convolutions which can be formed in a punch process. The die 2000 is mounted to a mounting plate on the coiler at the coil head forming stations by fasteners such as bolts which extend through fastener holes 2011 in the back wall 2004. By this arrangement, different coil head formation dies 2000 can be selectively installed with a coil forming machine for custom manufacture of different coil designs. By use of different coil formation and coil head formation dies, the design variations may include either the terminal convolution or the coil head.

Figure 22:
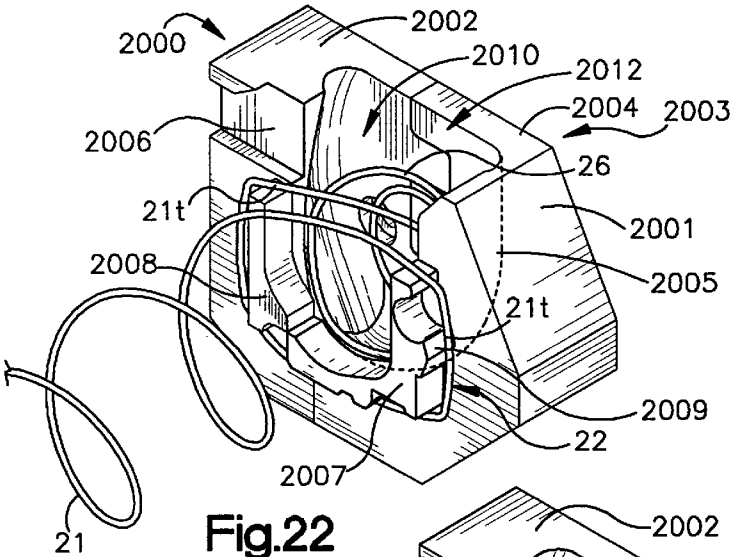

As a coil 2 is advanced by the geneva arm 222 from the coil forming block 208 to the first coil head forming station 230, the terminal convolution 26 is positioned within cavity 2010. The larger radius turn 21*t* of the helical coil body 21 proximate to the terminal convolution 26 is positioned over or around flanges 2007, 2008 as shown in FIG. 22. The punch dies 232 are positioned to strike the wire of turn 21*t* against the side walls 2009 of flanges 2007, 2008 to form the described offsets or contours or bends of the coil head 22 according to the relative locations of the side walls 2009 of flanges 2007, 2008. As shown in FIG. 22, the wire of turn 21*t* is in contact with the outermost portions of the side walls 2009 and closely proximate to the intersection of the side walls 2009 with the perpendicular surfaces of the side sections 2005, 2006.

The geneva engages the coil end with the die 2000, inserting the terminal convolution 26 into the die cavity 2010 through the opening 2078 formed by flanges 2007, 2008, and positioning the end turn of the coil body about the side walls 2009 of flanges 2007, 2008 by passing the terminal convolution of the coil over a compression plate 2015 (shown in FIG. 2) positioned proximate to the head forming station. The end of the coil, including the terminal convolution 26, is axially compressed to a point past the outermost edge of flanges 2007, 2008, so that as the compressed coil is carried past the shield, it expands so that the terminal convolution 26 pops into the die cavity 2010, and the first turn 21*t* of the coil body is engaged about the flanges 2007, 2008, snug against the side walls 2009 of flanges 2007, 2008. The side walls 2009 of flanges 2007, 2008 are tapered to facilitate both coil entry into the die 2000 and exit once the coil head is formed.

The geneva then advances the coil to a tempering station 250 where an electrical current is passed through the coil to temper the steel wire. The next advancement of the geneva inserts the coil into a conveyer, 301 or 302, which carries the coils to a coil transfer machine as further described below. As shown in FIG. 1, one or more coil formation machines may be used simultaneously to supply coils in the innerspring assembly system.

Coil Conveyance

Figure 3A:
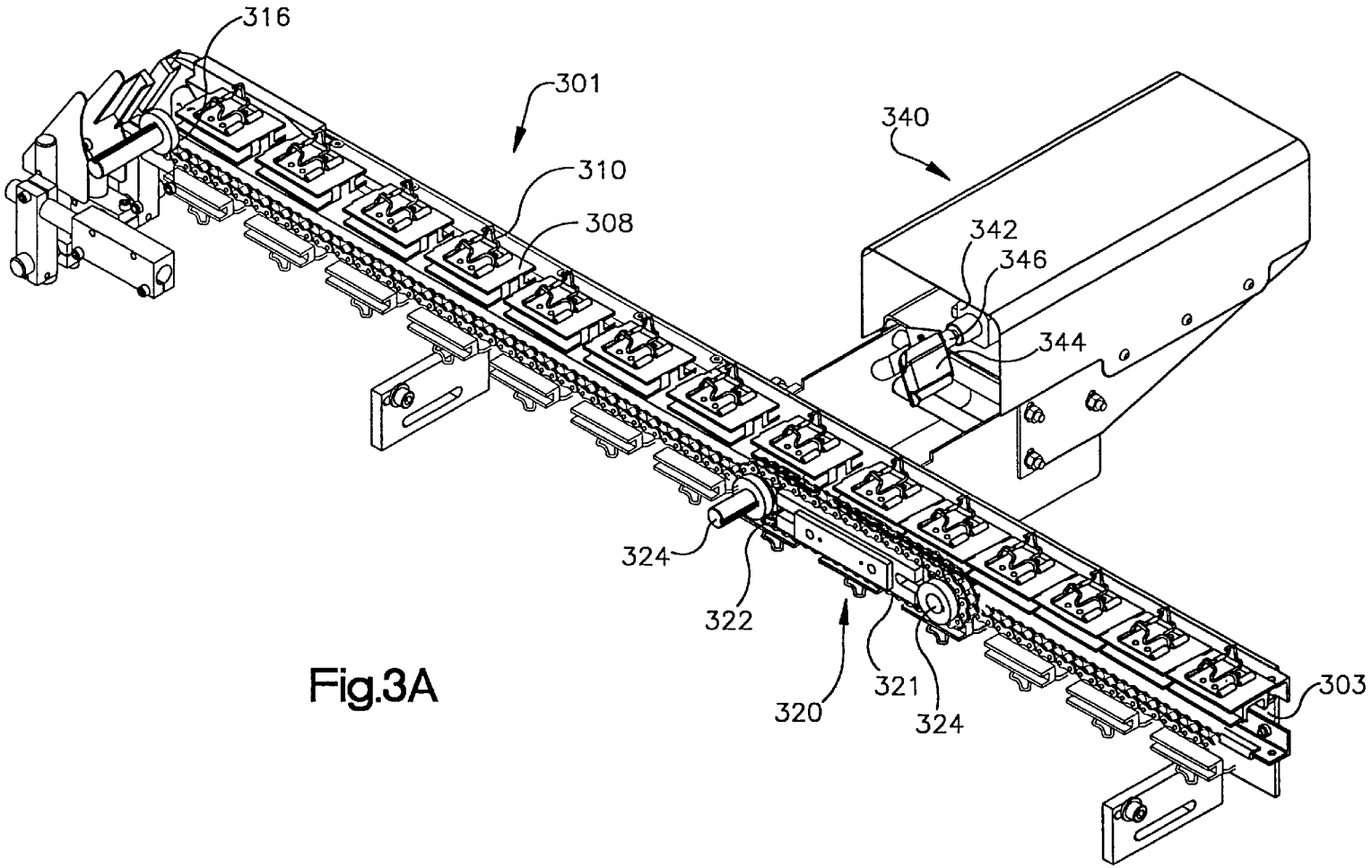
FIG. 3A is a perspective view of a conveyance device of the present invention.
Figure 3B:
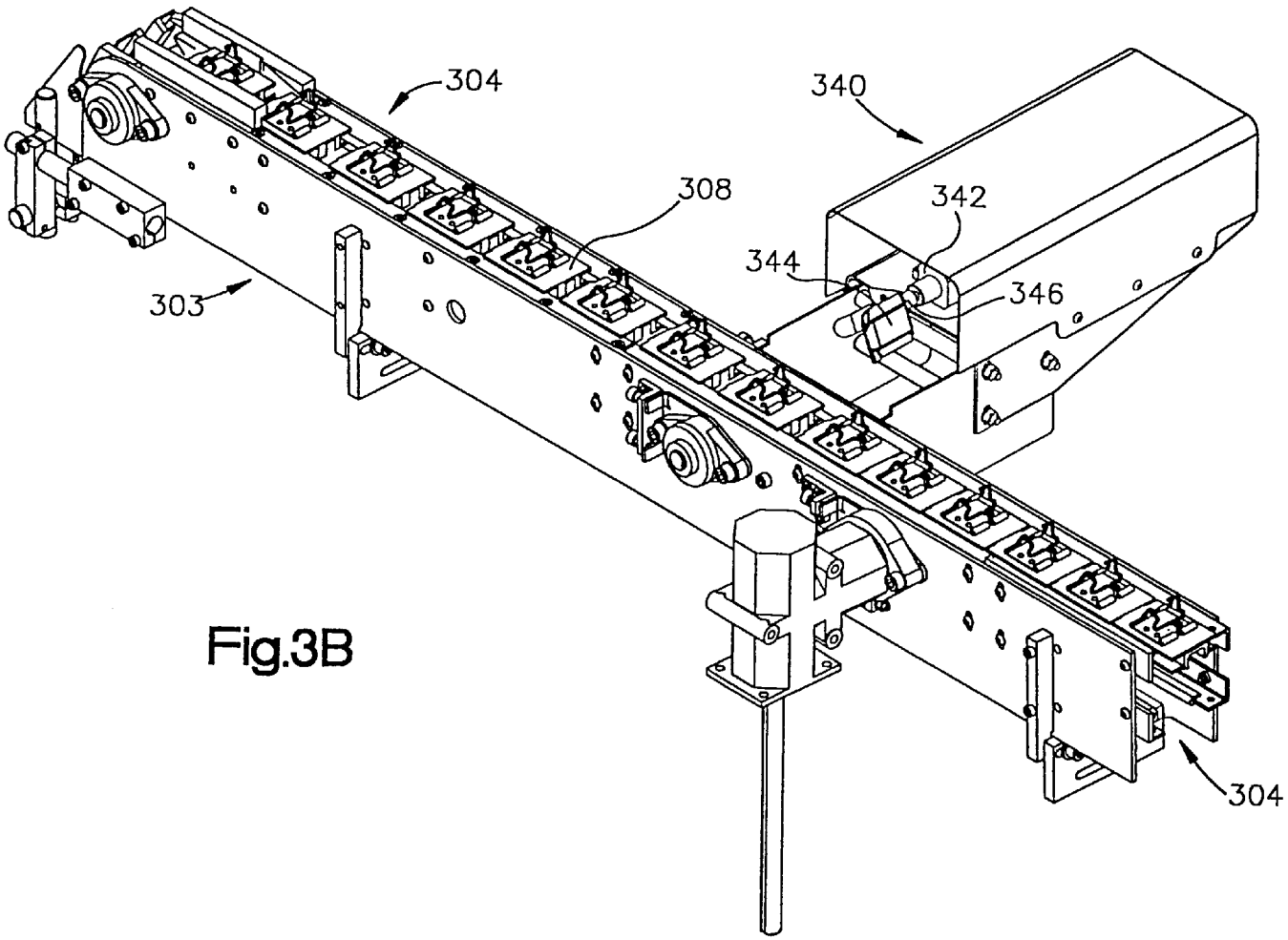
FIG. 3B is a perspective view of the conveyance device of FIG. 3A.
Figure 3D:
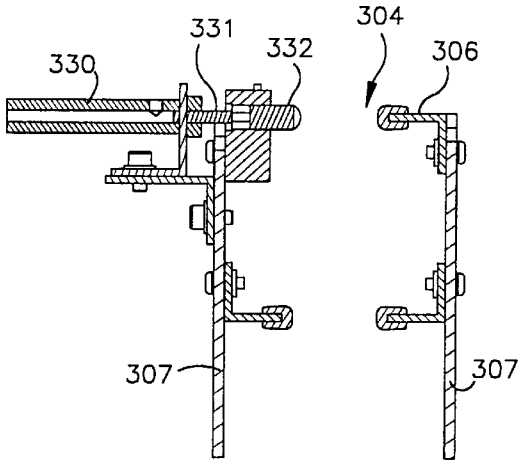
FIG. 3D is a sectional view of the conveyance device of FIG. 3D.

As shown in FIG. 1, coils 2 are conveyed in single file fashion from each of the coil formation machines 201, 202 by respective similarly constructed coil conveyors 301, 302 to a coil transfer machine 400. Although described as coil conveyors in the context of an innerspring manufacturing system, it will be appreciated that the conveyance systems of the invention are readily adaptable and applicable to any type of system or installation wherein conveyance of any type of object or objects is required. As further shown in FIGS. 3A–3E, conveyer 301 includes a box beam 303 which extends from the geneva 220 to a coil transfer machine 400. Each beam 303 includes upper and lower tracks 304 formed by opposed rails 306, mounted upon side walls 307. A plurality of flights 308 are slidably mounted between rails 306. Each flight 308 has a clip 310 configured to engage a portion of a coil, such as two or more turns of the helical body of a coil, as it is loaded by the geneva 220 to the conveyor. As further shown in FIGS. 3C and 3E, each flight 308 has a body 309 with opposed parallel flanges 311 which overlap and slide between rails 306. A bracket 312 depends from the body 309 of each flight. Each bracket is attached to a pair of adjacent pins 313 of links 314 of a main chain 315, with additional link 314 between each of the flights. The main chain 315 extends the length of the beam 302 and is mounted on sprockets 316 at each end of each beam. The flights 308 are thus evenly spaced along the main chain 315.

To translate the flights 308 in an evenly spaced progression along track 304, an indexer 320 is mounted within the box beam 303. The index 320 includes two parallel indexer chains 321 which straddle the main chain 315 and ride on co-axial pairs of sprockets 322. The sprockets 322 are mounted upon shafts 324. The chains 321 carry attachments 323 at an equidistant spacing, equal to the spacing of the flights 308 when the main chain 315 is taut. Once the main chain is no longer driven by the indexer, the main chain goes slack and the flights begin to stack against one another, as shown at the right side of FIGS. 3A and 3B. Now the pitch between flights is no longer determined by the distance between attachments on the main chain, but by the length of the flight bodies 309 which abut. This allows the conveyor to be loaded at one pitch, and unloaded at a different pitch.

The conveyor is further provided with a brake mechanism. As shown in FIG. 3D, a brake mechanism includes a linear actuator 331 with a head 332 driven by an air cylinder 330 or equivalent means to apply a lateral force to a flight positioned next to the actuator, thus pinching the flight against the interior side of the track 304. By controlling the air pressure in the air cylinder 330, the degree and timing of the resulting braking action of flights along the conveyor can be selectively controlled.

Figure 3E:
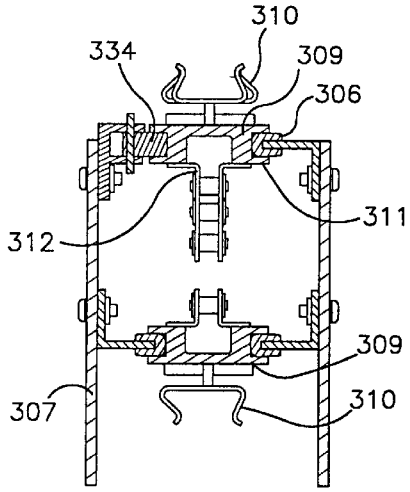
FIG. 3E is a sectional view of the conveyance device of FIG. 3C.
Figure 3C:
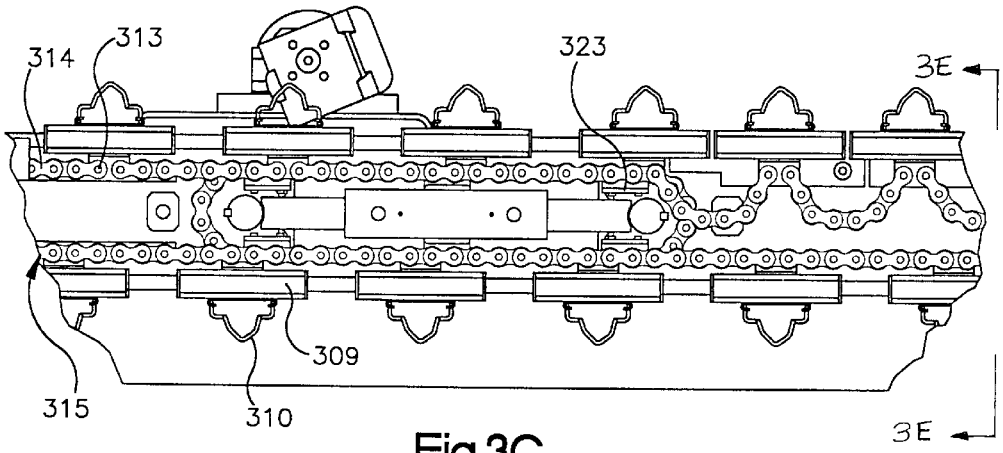
FIG. 3C is a cross-sectional side view of the conveyance device of FIG. 3A.

Alternatively, as shown in FIG. 3E, a fixed rate spring 334 may be incorporated into the horizontal flange of a track 304 where it is passed by each flight and applies a constant braking force to each of the flights. The size or rate of the spring can be selected depending upon the amount of drag desired at the brake point along the conveyor track.

Associated with each coil conveyor is a coil straightener, shown generally at 340 in FIGS. 3A and 3B. The coil straightener 340 operates to uniformly orient each coil within a flight clip 310 for proper interface with coil transfer machinery described below. Each straightener 340 includes a pneumatic cylinder 342 mounted adjacent beam 303. An end effector 344 is mounted upon a distal end of a rod 346 extending from the cylinder 342. The pneumatic cylinder is operative to impart both linear and rotary motion to the rod 346 and end effector 344. In operation, as a coil is located in front of the straightener 340 during passage of a flight, the end effector 344 translates out linearly to engage the presented end of the coil and simultaneously or subsequently rotates the coil within the flight clip to a uniform, predetermined position. The helical form of the coil body engaged in the flight clip allows the coil to be easily turned or "screwed" in the clip 310 by the straightener. Each coil in the conveyors is thereby uniformly positioned within the flight clips downstream of the straightener.

Figure 15A:
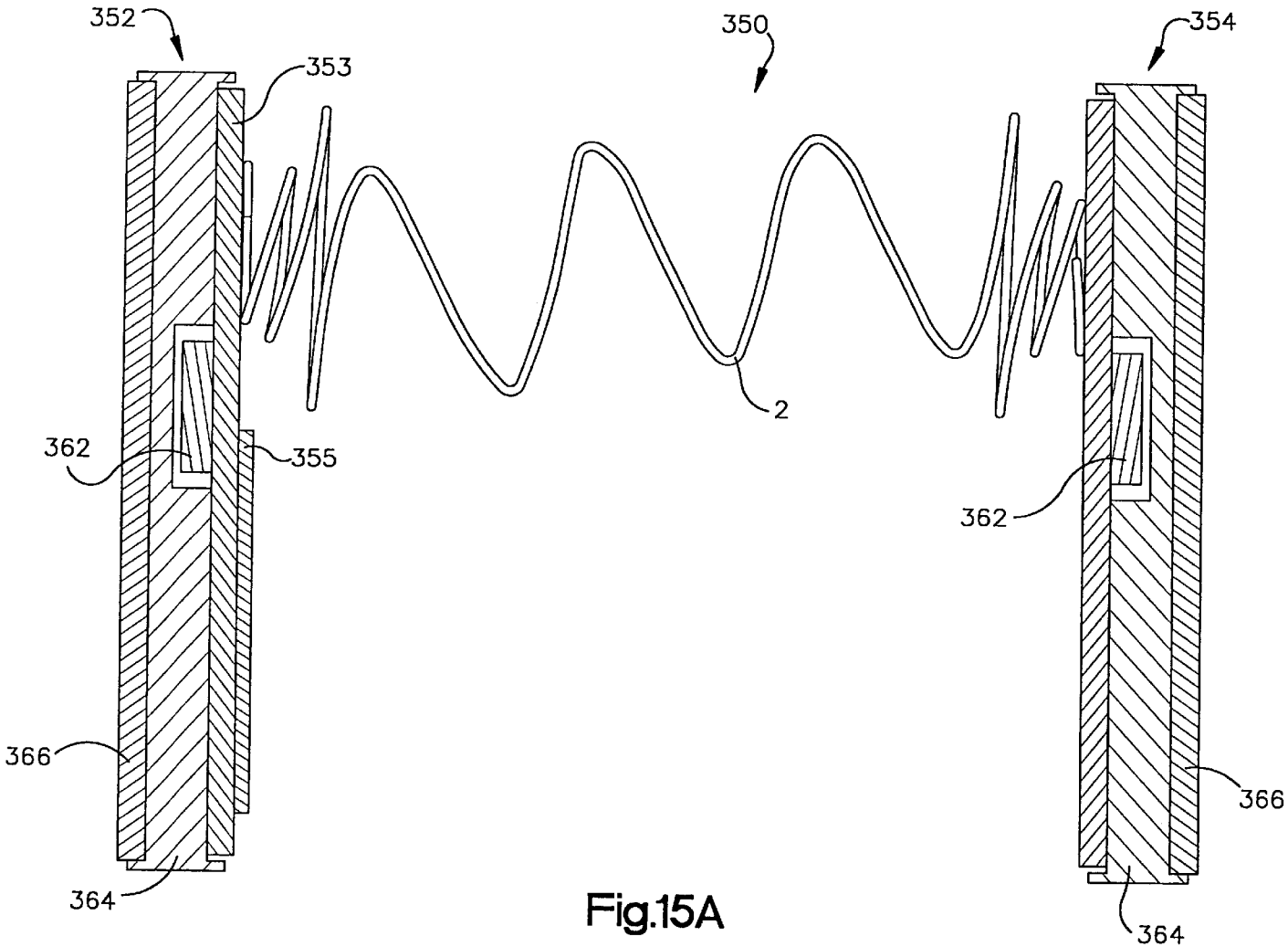
FIGS. 15A–15D are cross-sectional views of a belt-type coil conveyance system of the present invention.
Figure 15B:
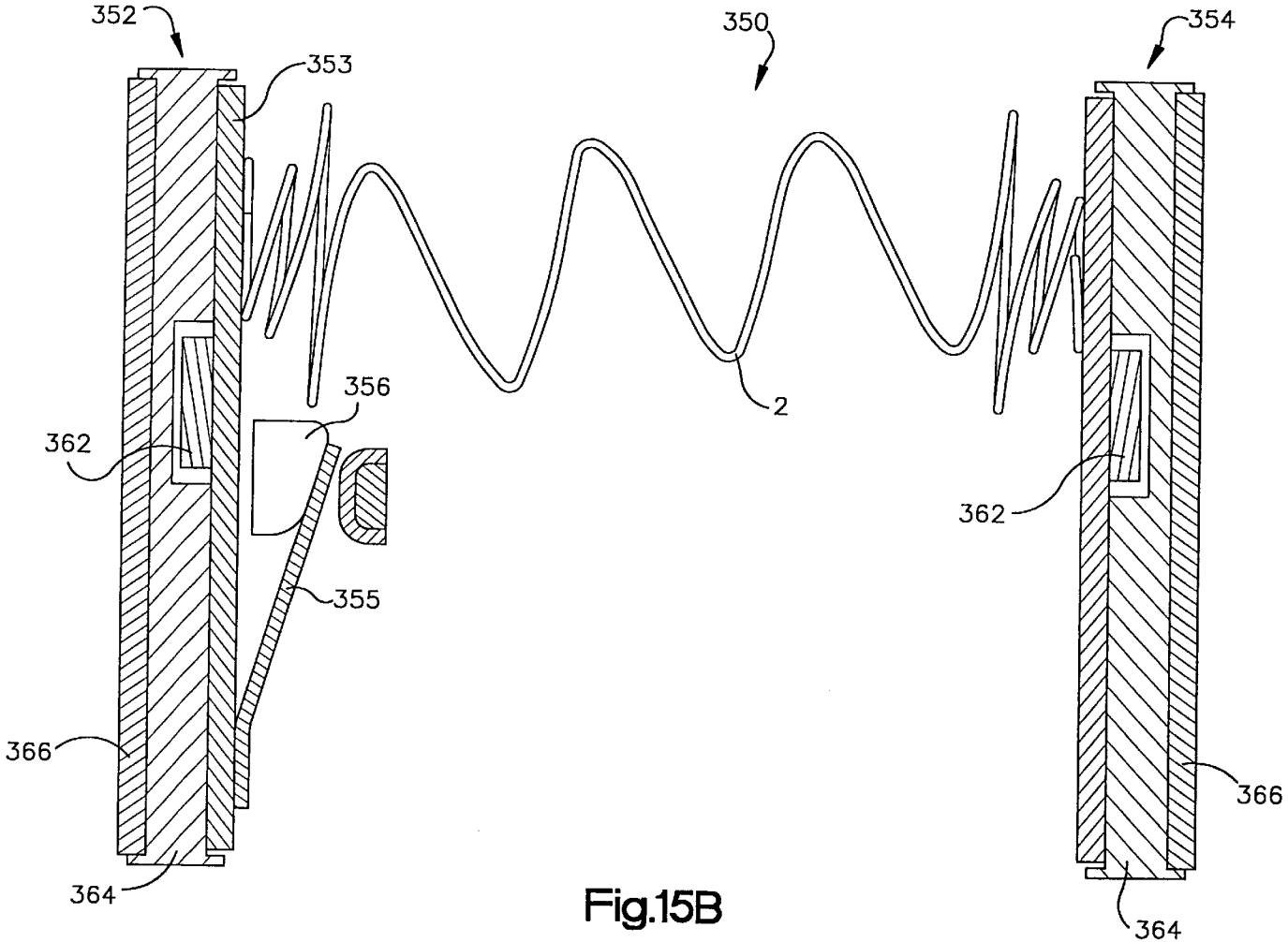
Figure 15C:
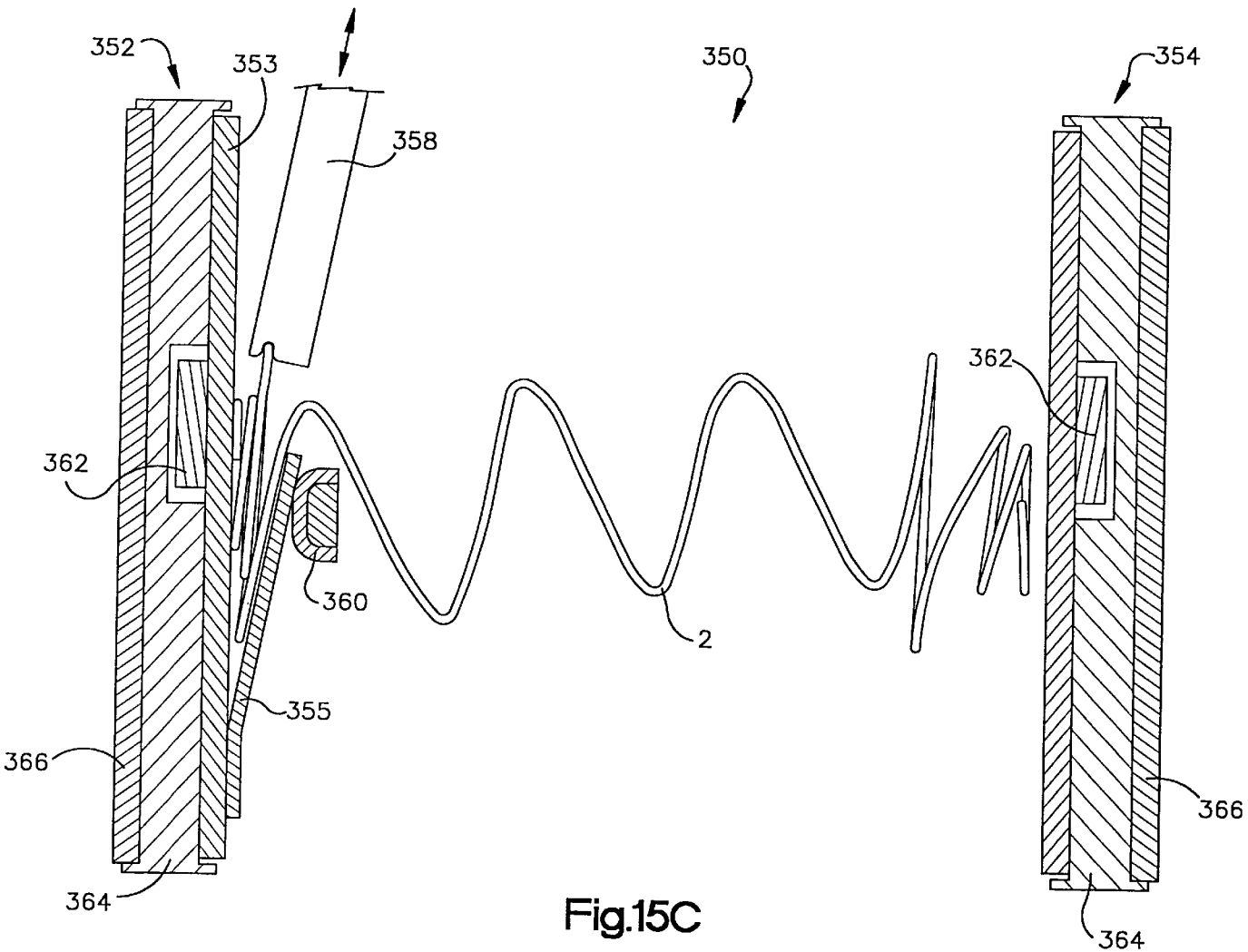
Figure 15D:
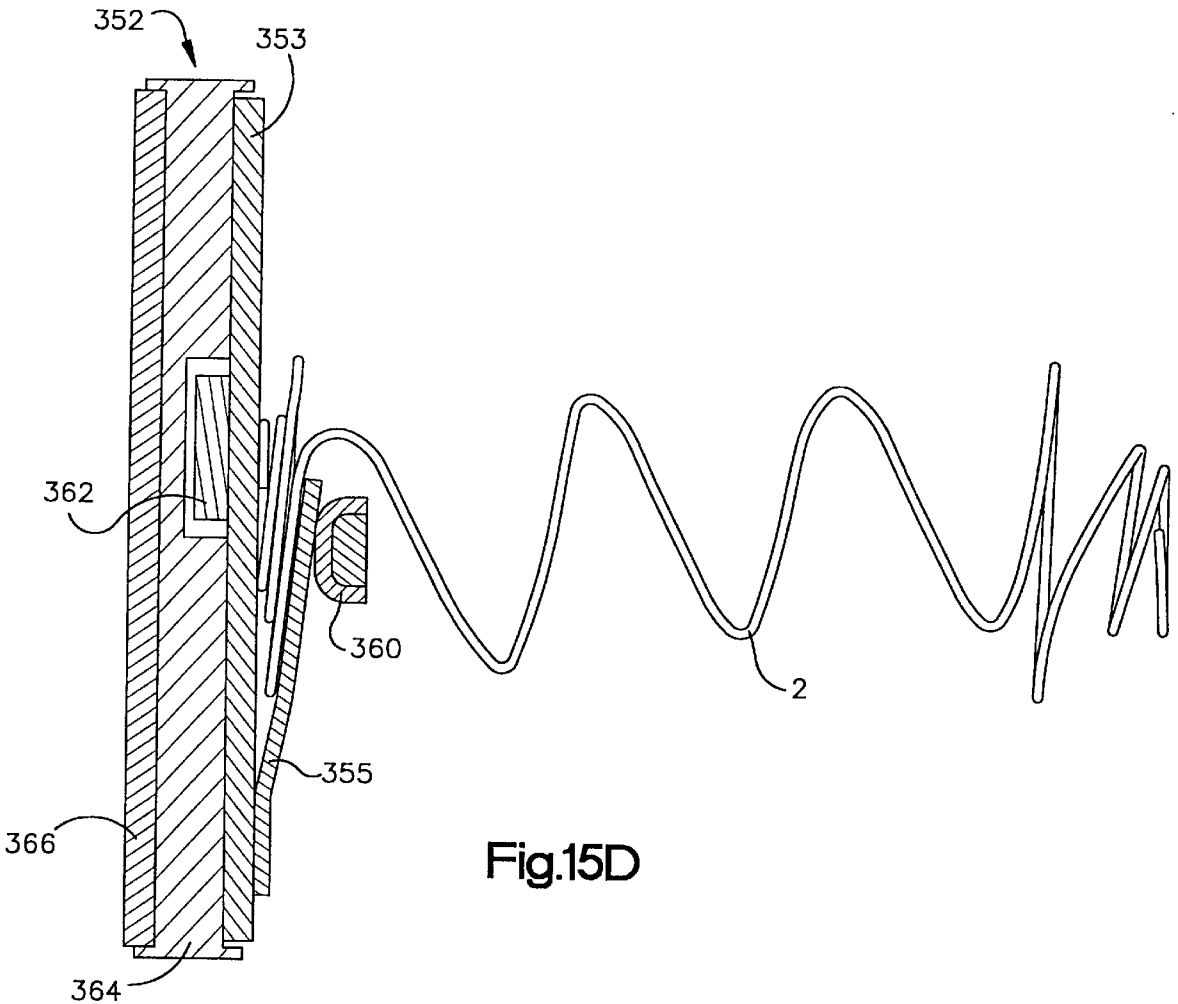

The described coil conveyance can also be accomplished by certain alternative mechanisms which are also a part of the invention. As shown in FIGS. 15A–15D, an alternate device for conveying coils from a coil former to a coil transfer station is a belt system, indicated generally at 350, which includes a pocketed flap belt 352 and an opposing belt 354. Coils 2 are positioned by a geneva to extend axially between the belts 352 and 354, as shown in FIG. 15A. The flap belt 352 has a primary belt 353 and a flap 355 attached to the primary belt 353 along a bottom edge. As shown in FIG. 15B, a fixed opening wedge 356 spreads the flap 355 away from the primary belt 353 to facilitate insertion of the coil head into the pocket formed by the flap and primary belt. An automated insertion tool may be used to urge the coil heads into the pocket. As shown in FIG. 15C, a straightening arm 358 is configured to engage a portion of the coil head, and driven to uniformly orient the coils within the pocket. Once inserted into the pocket and correctly oriented, the coils are held in position relative to the belts by a compressing bar 360 against which the exterior surface of flap 355 bears. The compressing bar 360 is movable at the region where the coils are removed from the belt by a coil transfer machine, to release the pressure on the flap to allow removal of the coils from the pocket. As further shown, the primary belt 353 and opposing belt 354 are each attached to a timing belt 362, a flexible plastic backing 364, and a backing plate 366 which may be steel or other rigid material. This construction gives the belt the neccesary rigidity to securely hold the coils between them, and sufficient flexibility to be mounted upon and driven by pulleys, and to make turns in the conveyance path.

Figure 16:
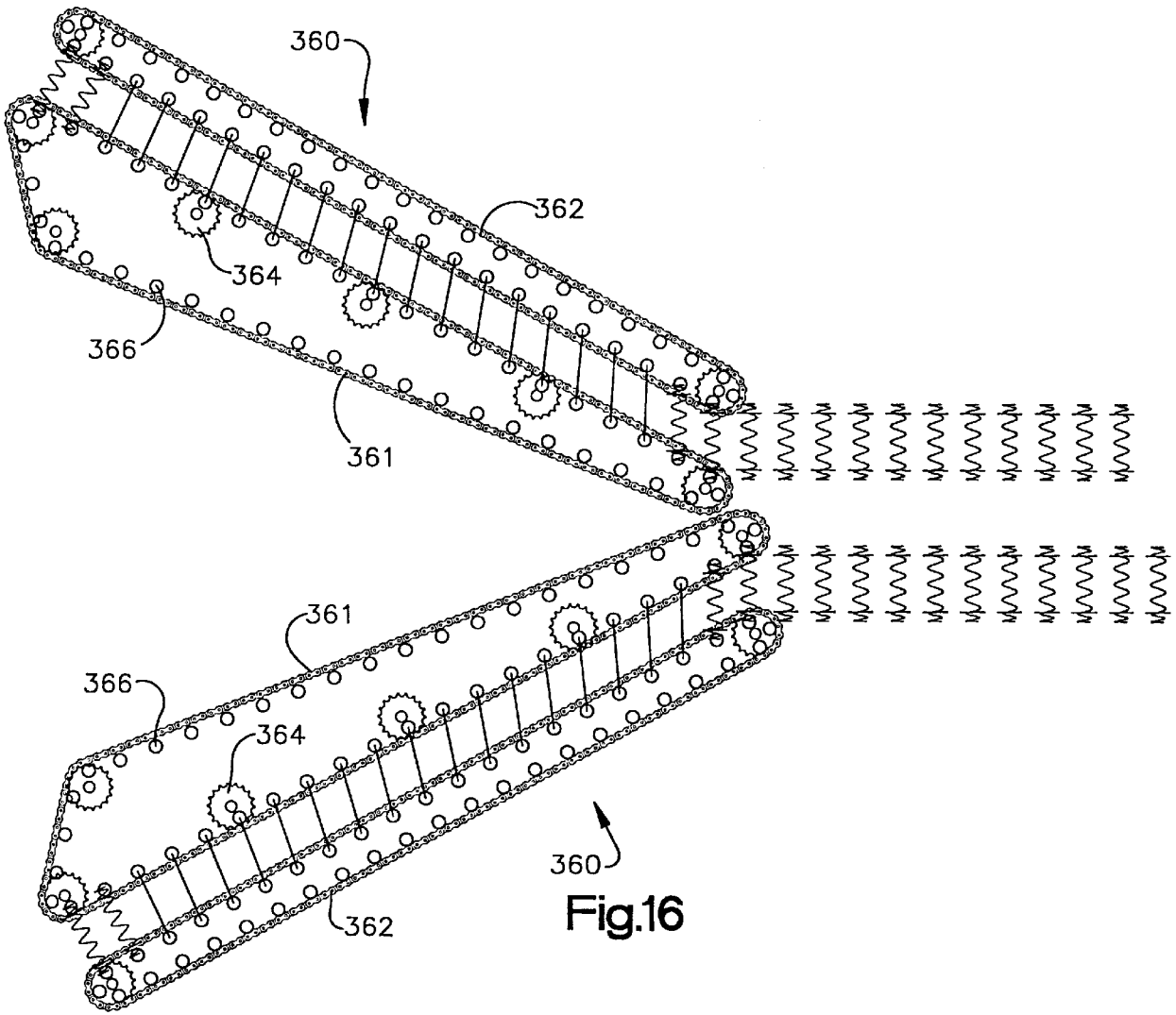
FIG. 16 is a top view of a chain winder version of a coil conveyance system of the present invention.

FIG. 16 illustrates pairs of spring winders 360 which can be employed as alternate coil conveyance mechanisms in connection with the system of the invention. Each spring winder 360 includes a primary chain 361 and secondary chain 362 driven by sprockets 364 to advance at a common speed from a respective coil former to a coil transfer station or assembler as further described below. Coil engaging balls 366, dimensioned to fit securely within the terminal convolutions of the coils, are mounted at equal spacings along the length of each chain. The chains are timed to align the balls 366 in opposition for engagement of a coil presented by the geneva. Each chain may be selectively controlled to change the relative angle of the coils as they approach the coil transfer stage, as shown at the right side of FIG. 16. Magnets may be used in addition to or in place of balls 366 to hold the coils between the sets of chains.

Coil Transfer

Figure 4A:
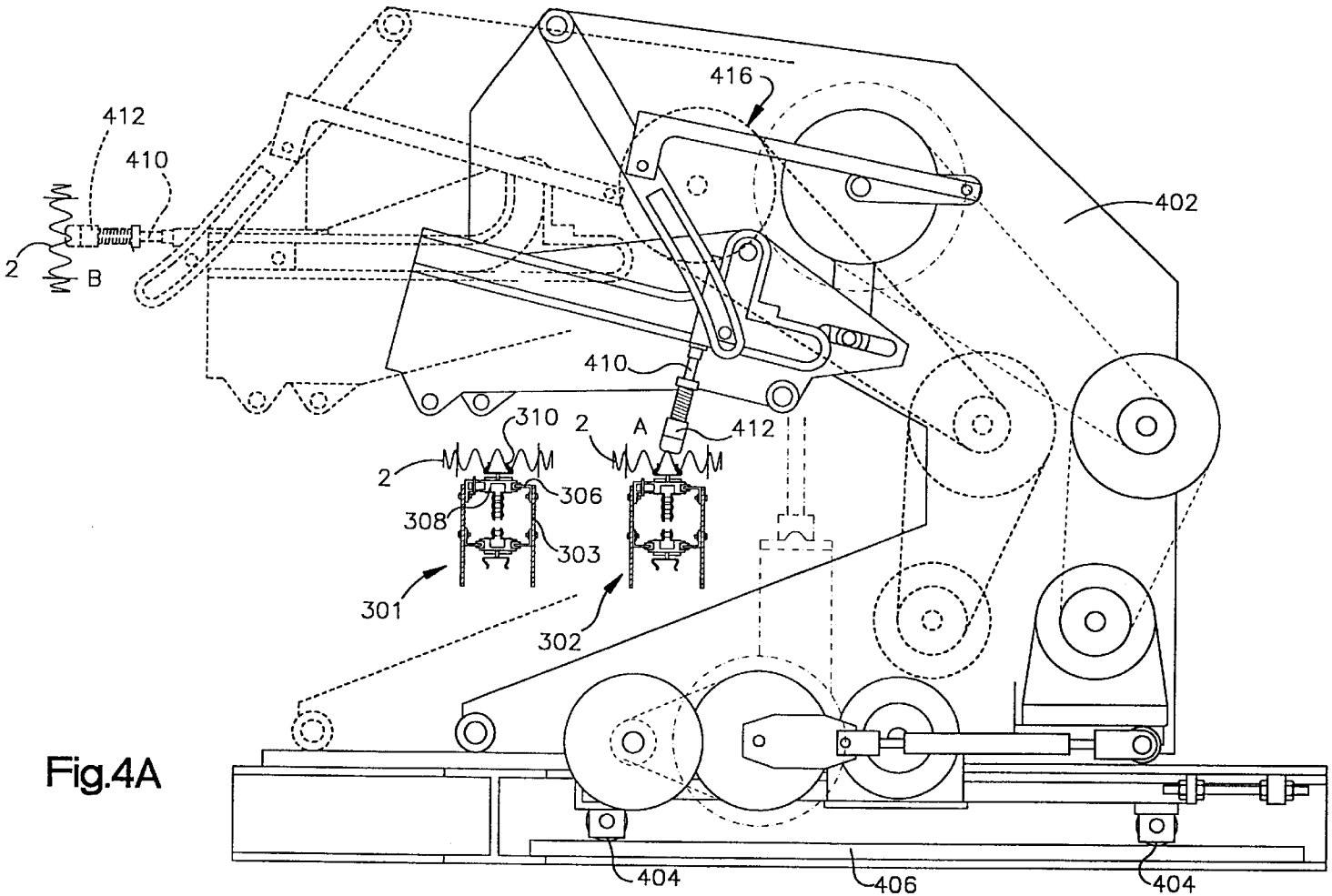
FIG. 4A is a side elevation of a coil transfer machine used in connection with the machinery for automated manufacture of formed wire innerspring assemblies of the present invention.
Figure 4B:
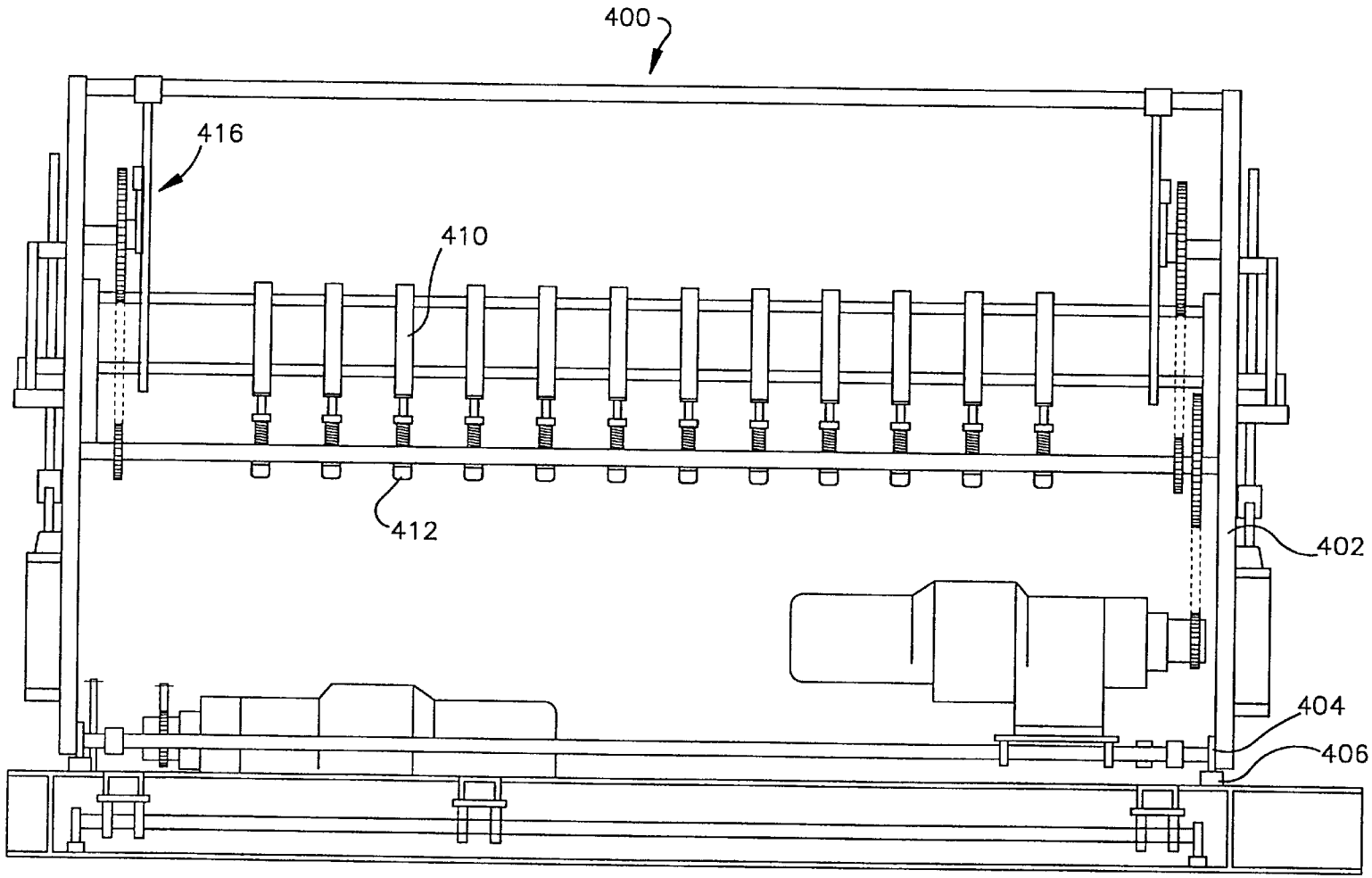
FIG. 4B is a side elevation of the coil transfer machine of FIG. 4A.

As shown in FIGS. 1 and 4A and 4B, each conveyor 301, 302 positions a row of coils in alignment with a coil transfer machine 400. The coil transfer machine includes a frame 402 mounted on rollers 404 on tracks 406 to linearly translate toward and away from conveyors 301, 302 and the innerspring assembler 500. A linear array of arms 410 with grippers 412 grip an entire row of coils from the flights 304 of one of the conveyors and transfer the row of coils into the innerspring assembler. The number of operative arms 410 on the coil transfer machine is equal to a number of coils in a row of an innerspring to be produced by the assembler. By operation of a drive linkage schematically shown at 416, in combination with linear translation of the machine upon tracks 406. The coil transfer machine lifts an entire row of coils from one of the conveyors (at position A) and inserts them into an innerspring assembly machine 500. Such a machine is described in U.S. Pat. No. 4,413,659, the disclosure of which is incorporated herein by reference. The innerspring assembler 500 engages the row of coils presented by the transferor as described below. The coil transfer machine 400 then picks up another row of coils from the other parallel conveyor (301 or 302) and inserts them into the innerspring assembly machine for engagement and attachment to the previously inserted row of coils. After the coils are removed from both of the conveyors, the conveyors advance to supply additional coils for transfer by the coil transfer machine into the innerspring assembler.

Innerspring Assembler

The primary functions of the innerspring assembler 500 are to:

(1) grip and position at least two adjacent parallel rows of coils in a parallel arrangement;

(2) connect the parallel rows of coils together by attachment of fastening means, such as a helical lacing wire to adjacent coils; and (3) advance the attached rows of coils to allow introduction of an additional row of coils to be attached to the previously attached rows of coils, and repeat the process until a sufficient number of coils have been attached to form a complete innerspring assembly.

Figure 7A:
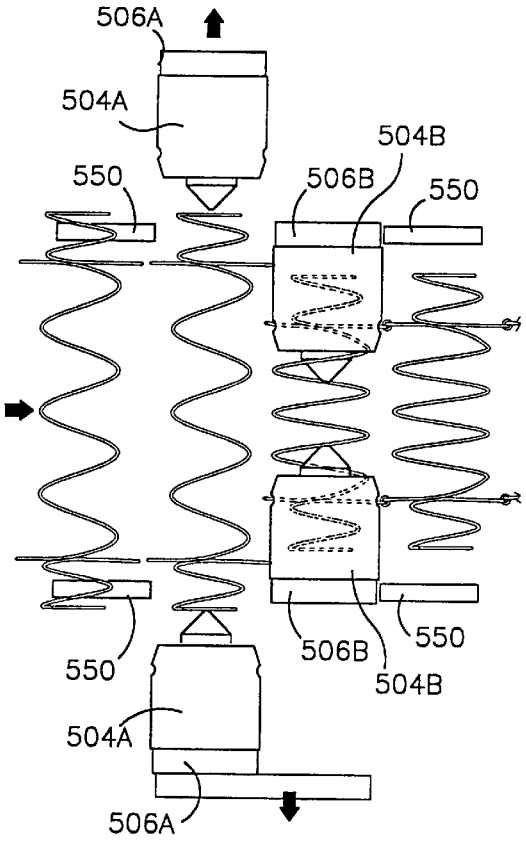
Figure 7B:
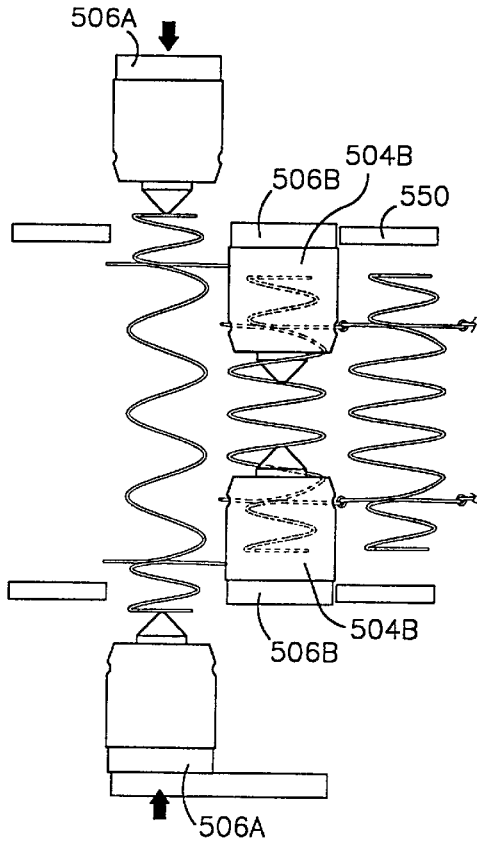
Figure 7C:
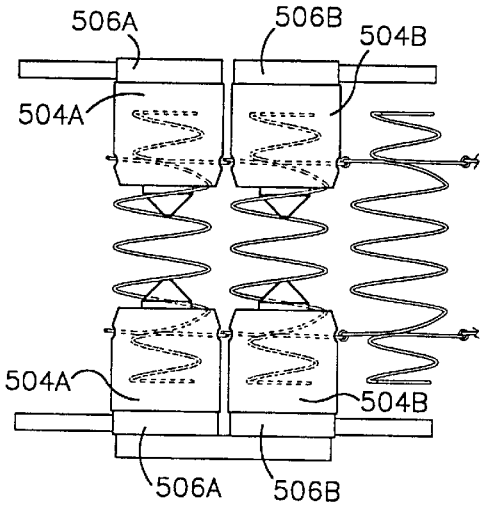
Figure 7D:
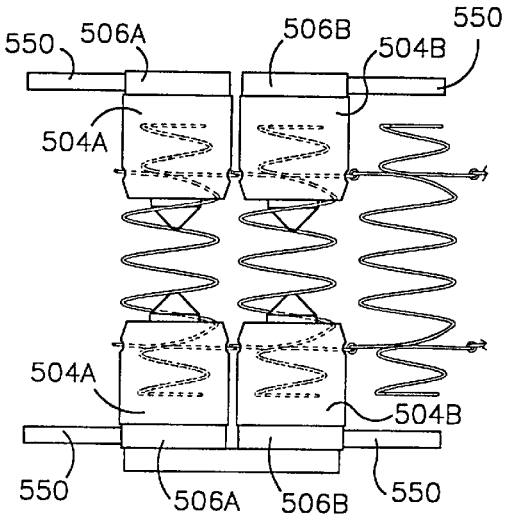

As shown in FIGS. 5, 6, 9–10, the innerspring assembler 500 is mounted upon a stand 502 of a height appropriate to interface with the coil transfer machine 400. The innerspring assembler 500 includes two upper and lower parallel rows of coil-receiving dies, 504A and 504B which receive and hold the terminal ends of each of the coils, with the axes of the coils in a vertical position, to enable insertion or lacing of fastening means such as a helical wire between the coils, and to advance attached rows of coils out of the innerspring assembler. The dies 504 are attached side-by-side upon parallel upper and lower carrier bars 506A, 506B which are vertically and horizontally (laterally) translatable within the assembler. The innerspring assembler operates to move the carrier bars 506 with the attached dies 504 to clamp down on two adjacent rows of coils, fasten or lace the coils together to form an innerspring assembly, and advance attached rows of coils out of the assembler to receive and attach a subsequent row of coils. More specifically, the innerspring assembler operates in the following basic sequence, described with reference to FIGS. 7A–7I:

1) a first upper and lower pair of carrier bars 506A (with the attached dies 504A) are vertically retracted to allow for introduction of a row of coils from the coil transfer machine (FIG.7A);

2) the first upper and lower pair of carrier bars 506A are vertically converged upon a newly inserted row of coils (FIG. 7C);

3) adjacent rows of coils clamped between the upper and lower dies 504 are attached by fastening or lacing through aligned openings in the adjacent dies (FIG. 7D);

4) the second upper and lower pair of carrier bars 506B are vertically retracted to release a preceding row of coils from the dies (FIG. 7E), 5) the upper and lower carrier bars 506A are laterally translated to the position previously occupied by upper and lower carrier bars 506B, to advance the attached rows of coils out of the assembler (FIG. 7I), and 6) carrier bars 506B are laterally translated opposite the direction of translation of carrier bars 506A, to swap positions with carrier bars 506A to position the dies to receive the next row of coils to be inserted (FIG. 7I).

Figure 5:
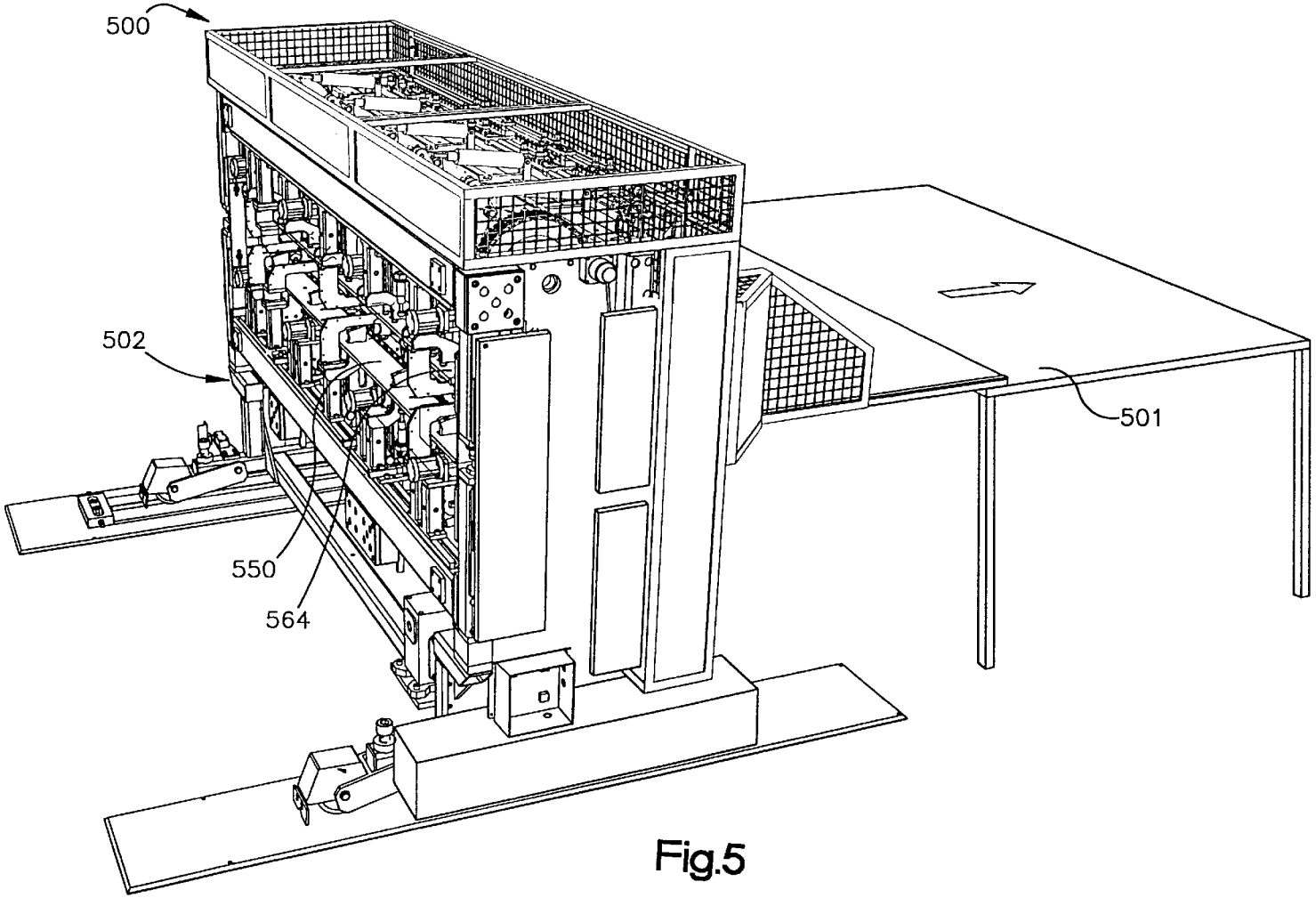
FIG. 5 is a perspective view of an innerspring assembly machine of the present invention.
Figure 7E:
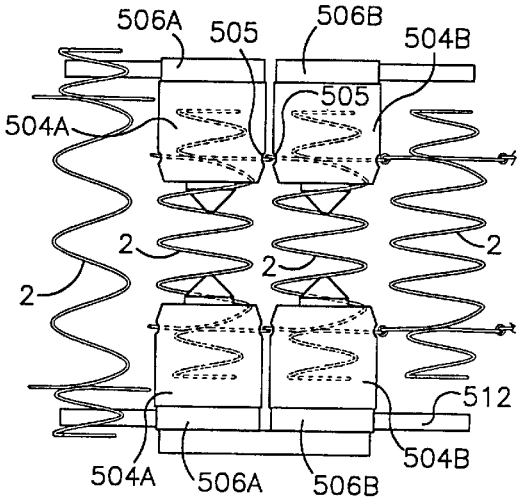
Figure 7F:
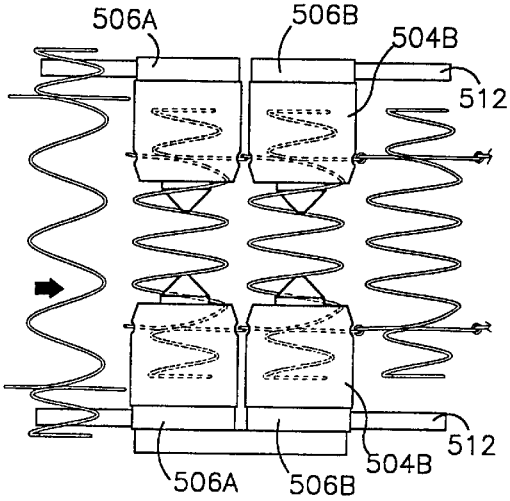
Figure 7G:
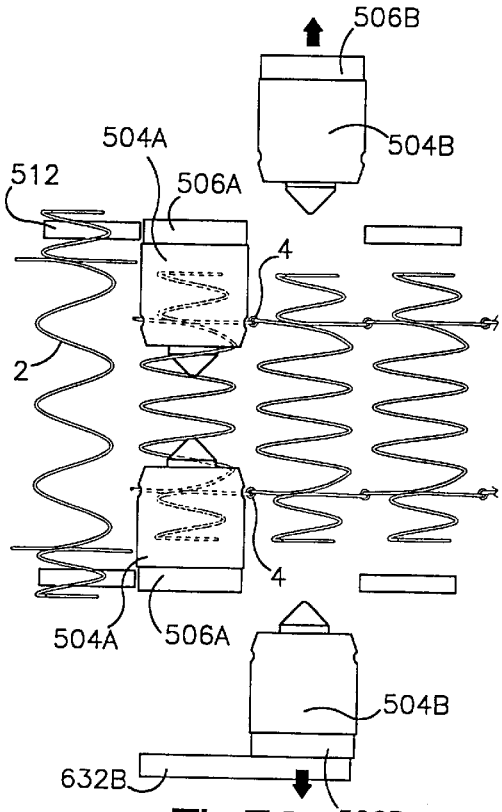
Figure 7H:
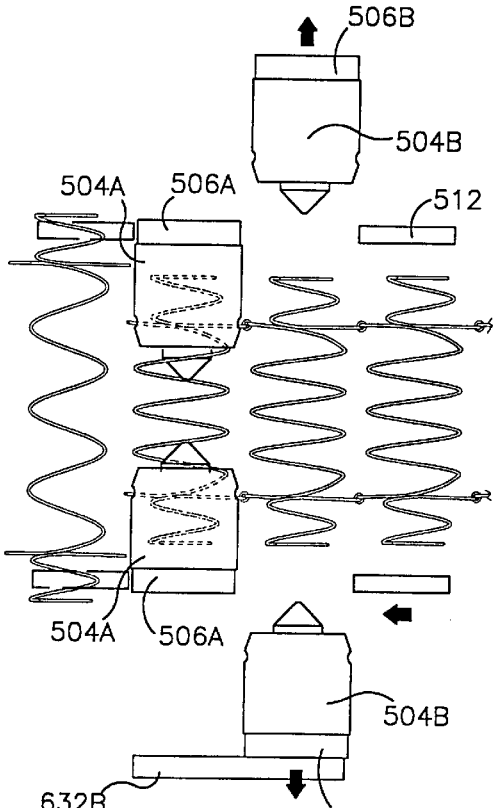
Figure 71:
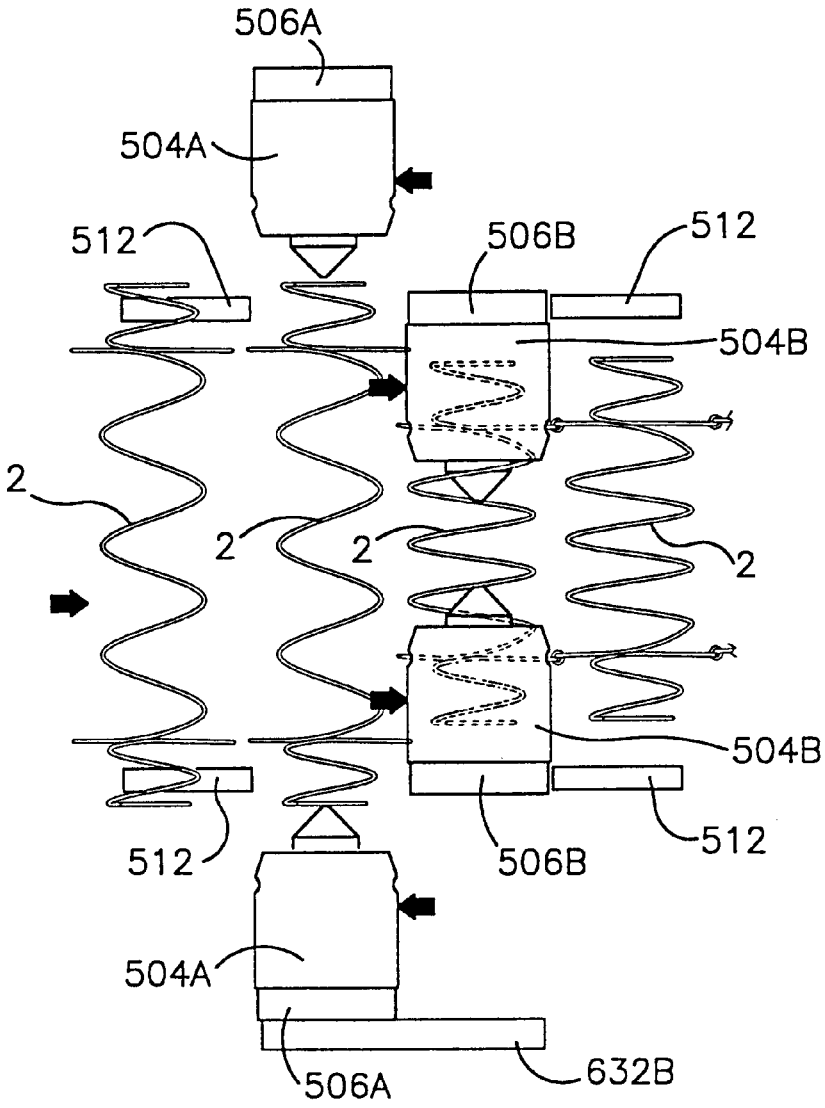

In FIG. 7A coils are presented to the innerspring assembler by the coil transfer machine in the indicated direction. Upper and lower rows of dies 504A, mounted upon upper and lower carrier bars 506A, are vertically retracted to allow the entire uncompressed length of the coils to be inserted between the dies. A previously inserted row of coils is compressed between upper and lower dies 504B, mounted upon upper and lower carrier bars 506B positioned laterally adjacent to carrier bars 506A (FIG. 7B). The upper and lower dies 504A are converged upon the terminal ends of the newly presented coils to compress the coils to an extent equal to the preceding coils in dies 504B (FIG. 7C). The horizontally adjacent carrier bars 506A and 506B are held tightly together by back-up bars 550 (schematically represented in FIG. 7D), actuated by a clamping mechanism described below. With the dies clamped together, the adjacent rows of coils compressed between the upper and lower adjacent dies 504A and 504B are fastened together by insertion of a helical lacing wire 4 through aligned cavities 505 in the outer abutting side walls of the dies, and through which a portion of each coil in a die passes (FIG. 7E). The lacing wire 4 is crimped at several points to secure it in place upon the coils. When the attachment of two adjacent rows of coils within the dies is complete, clamps 550 are released (FIG. 7F) and the upper and lower dies 504B are vertically retracted (FIG. 7G). The upper and lower dies 504A and 504B are then laterally translated or indexed in the opposite directions indicated (in FIG. 7I) or swapped , to laterally exchange positions, whereby one row of attached coils are advanced out of the innerspring assembler, and the empty dies 504B are positioned for engagement with a newly introduced row of coils. The described cycle is then repeated with a sufficient number of rows of coils interconnected to form an innerspring assembly which emerges from the assembler onto a support table 501, as shown in FIGS. 1 and 5.

Figure 8A:
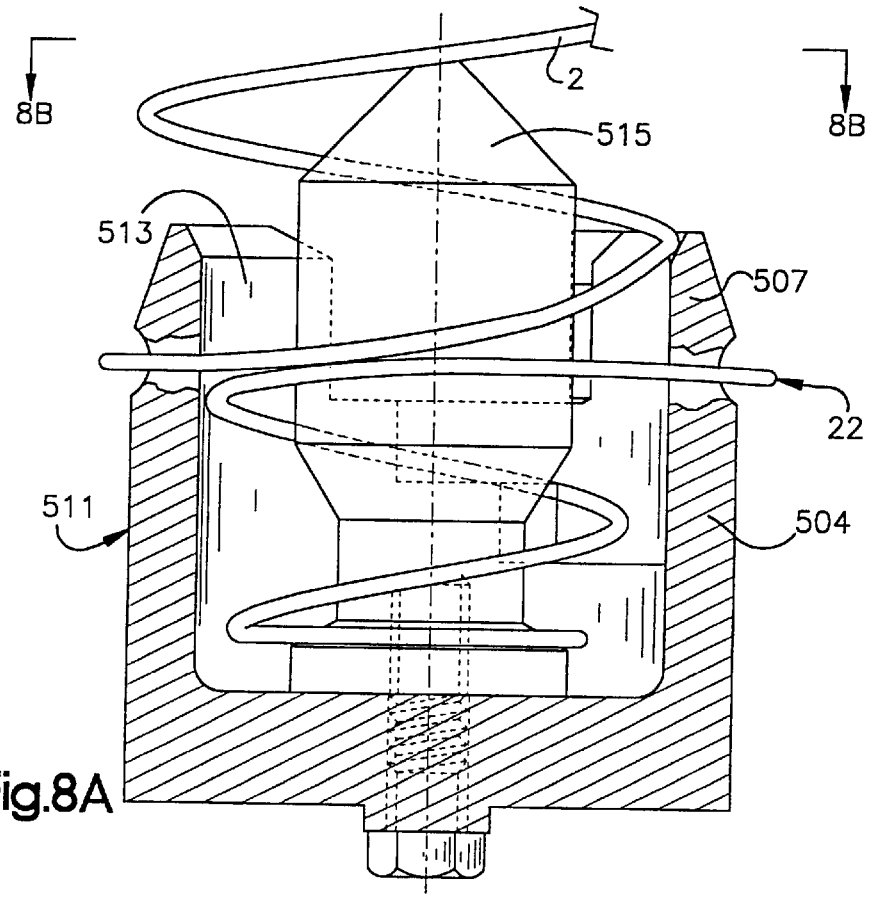
FIGS. 8A and 8B are cross-sectional and top views of a coil head formation die of the present invention, engaged with a wire coil.
Figure 8B:
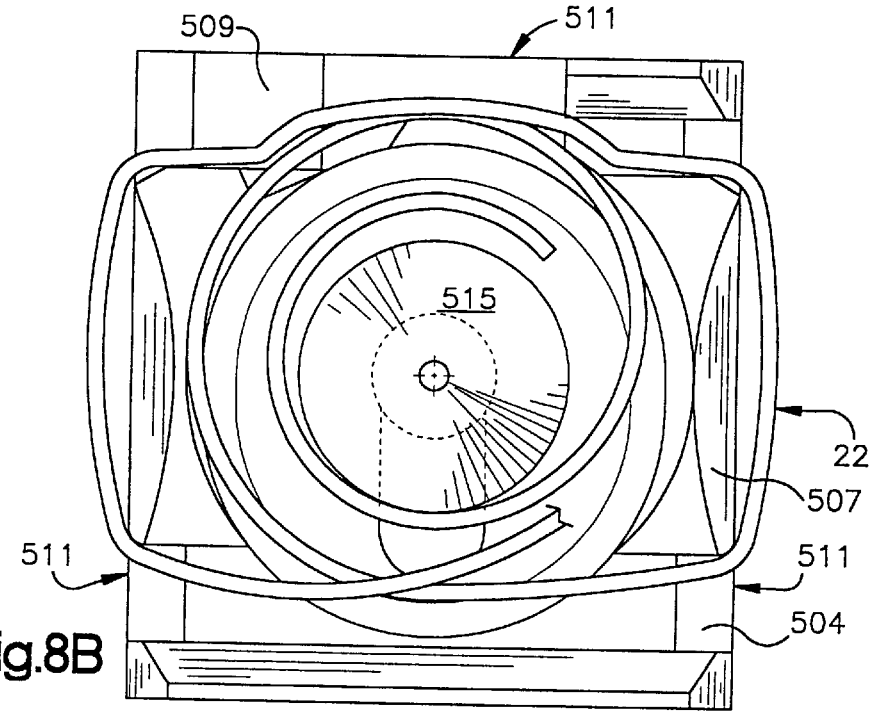

As shown in FIGS. 8A and 8B, the coil-engaging dies 504 are generally rectangular shaped blocks having tapered upward extending flanges 507 contoured to guide the head 22 of the coil 2 about the exterior of the die to rest upon a top surface 509 of side walls 511 of the die. As shown in FIG. 8A, two of the offsets of the coil head 22 extend beyond the side walls 511 of the die, next to an opening 505 through which the helical lacing wire 4 is guided to interconnect adjacent coils. A cavity 513 is formed in the interior of the die, within walls 511, in which a tapered guide pin 515 is mounted. The guide pin 515 extends upward through the opening to cavity 513, and is dimensioned to be inserted into the terminal convolution 28 of the coil which fits within cavity 513. The dies 504 of the present invention are thus able to accommodate coils having a terminal convolution which extends beyond a coil head, and to interconnect coils at points other than at the terminal ends of the coils.

Figure 9A:
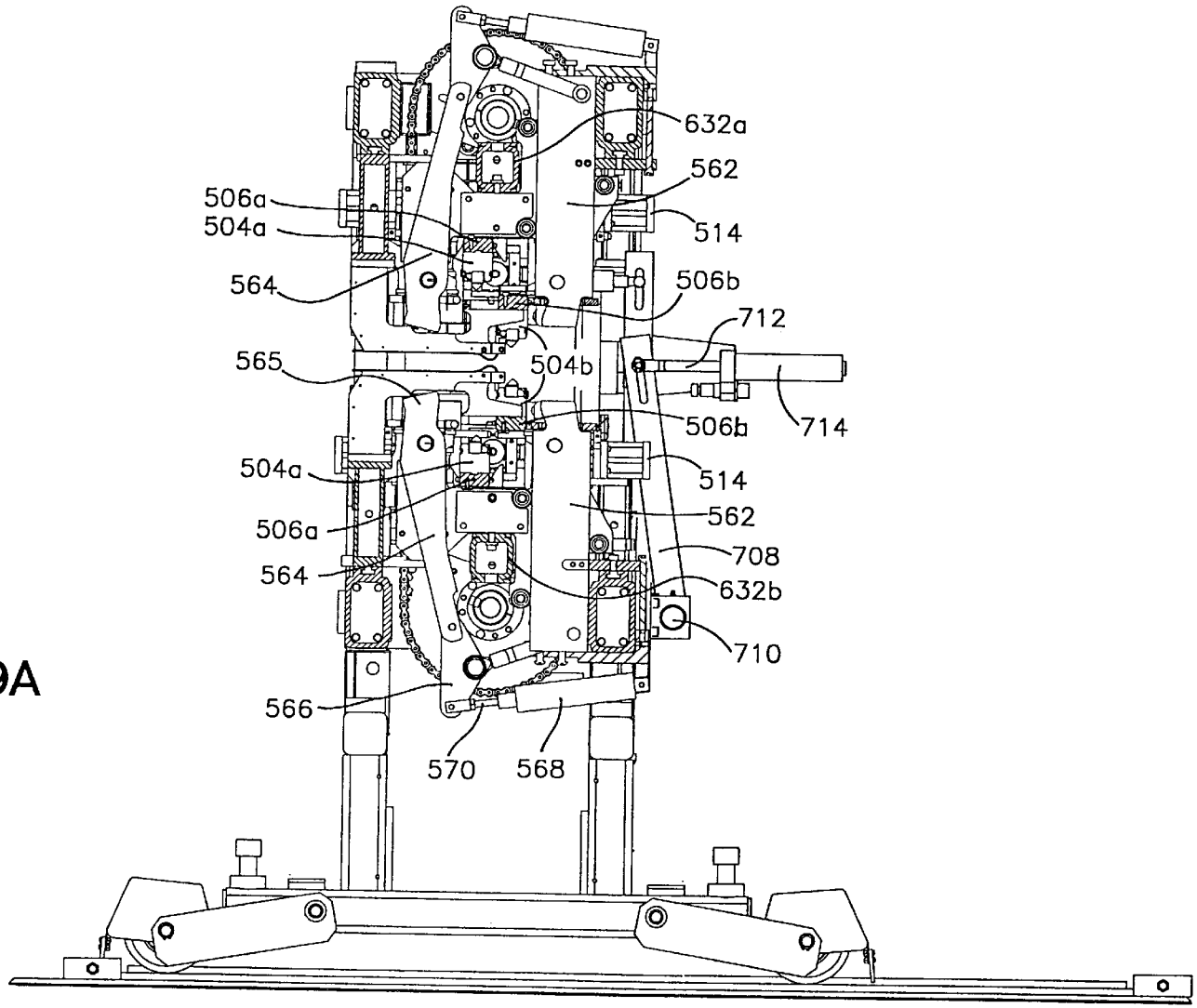
FIGS. 9A and 9B are end views of the innerspring assembly machine of FIG. 5.
Figure 9B:
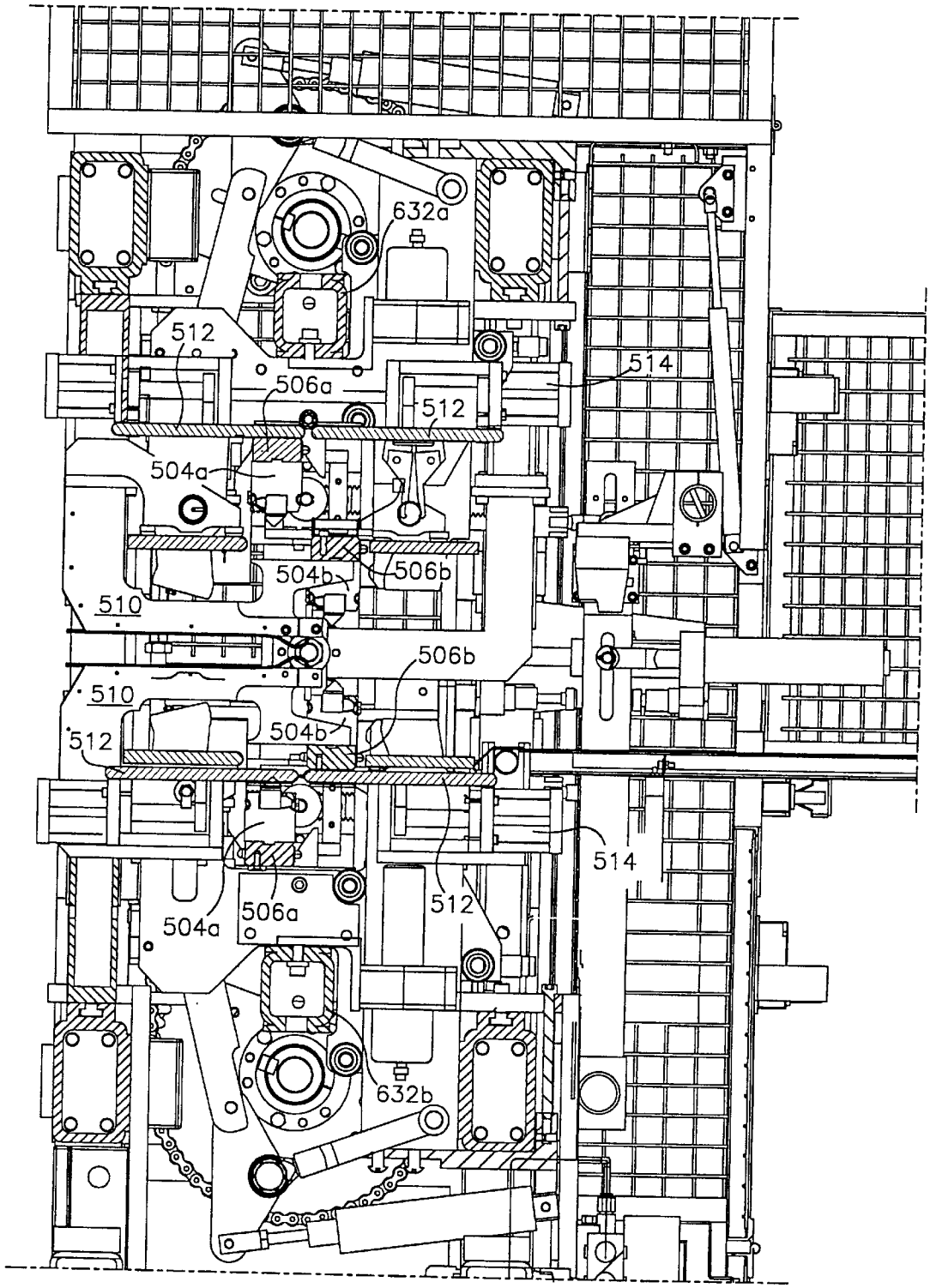

The mechanics by which the innerspring assembler translates the carrier bars 506 with the attached dies 504 in the described vertical and lateral paths are now described with continuing reference to FIGS. 7A–7I, and additional reference to FIGS. 9A and 9B, 10 and 11. The carrier bars 506 (with attached dies 504) are not permanently attached to any other parts of the assembler. The carrier bars 506 are thus free to be translated vertically and laterally by elevator and indexer mechanisms in the innerspring assembler. Dependent upon position, the carrier bars 506 and dies 504 are supported either by fixed supports or retractable supports. As shown in FIGS. 9A and 9B, the lowermost carrier bar 506A rests on a clamp assembly piece supported by a lower elevator bar 632B. The uppermost carrier bar 506A is supported by pneumatically actuated pins 512 which are extended directly into bores in a side wall of the bar, or through bar tabs attached to the top of the carrier bar and aligned with the pins 512. Actuators 514, such as for example pneumatic cylinders, are controlled to extend and retract pins 512 relative to the carrier bars. The pins 512 on the coil entry side of the innerspring assembler are also referred to as the lag supports. The pins 512 on the opposite or exit side of the assembler (from which the assembled innerspring emerges) are alternatively referred to as the lead supports. On the exit side of the assembler (right side of FIGS. 9A and 9B, left side of FIG. 10A), the upper carrier bar 506B (in a position lower than upper carrier bar 506A) is supported by fixed supports 510, and the lower carrier bar 506B is supported by lead support pins 512.

Figure 10A:
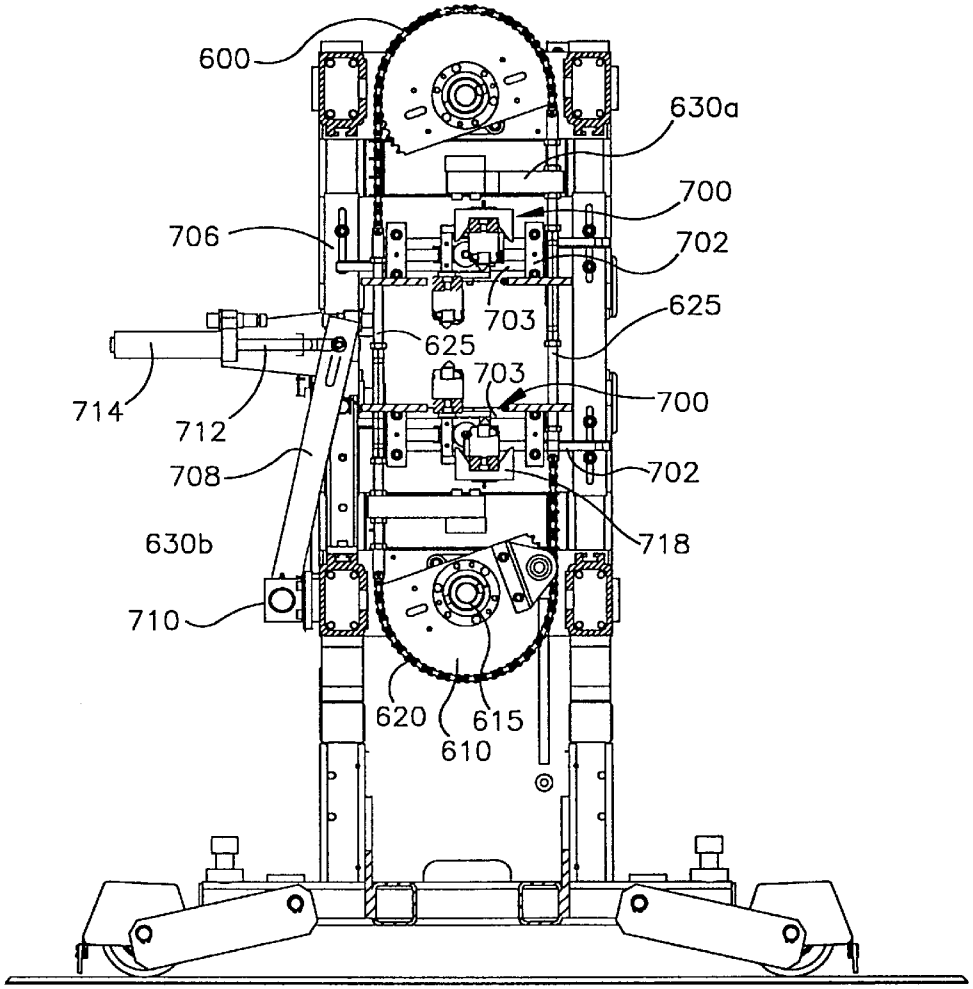
FIG. 10A is an end view of the innerspring assembly machine of FIG. 5.

As shown in FIG. 10A, a chain driven elevator assembly, indicated generally at 600, is used to vertically retract and converge the upper and lower carrier bars 506A and 506B through the sequence described with reference to FIGS. 7A–I. The elevator assembly 600 includes upper and lower sprockets 610, mounted upon axles 615, and upper and lower chains 620 engaged with sprockets 610. The opposing ends of the chains are connected by rods 625. Upper and lower chain blocks 630A and 630B extend perpendicularly from and between the rods 625, toward the center of the assembler. Lower axle 615 is connected to a drive motor (not shown) operative to rotate the associated sprocket 610 through a limited number of degrees sufficient to vertically translate the chain blocks 630A and 630B in opposite directions, to coverage or diverge, upon rotation of the sprockets. When the sprockets 610 are driven in a clockwise direction as shown in FIG. 10A, chain block 630A moves down, and chain block 630B moves up, and vice versa.

The chain blocks 630A and 630B are connected to corresponding upper and lower elevator bars 632A and 632B which run parallel to and substantially the entire length of the carrier bars. The upper and lower elevator bars 632A and 632B vertically converge and retract upon the described partial rotation of sprockets 610. The upper lead and lag support pins 512 and associated actuators 514 are mounted on the upper elevator bar 632A to move vertically up or down with the elevator assembly.

The two parallel sets of upper and lower carrier bars, 506A and 506B, are laterally exchanged (as in FIG. 7I) by an indexer assembly indicated generally at 700 in FIG. 10A. The indexer assembly includes, at each end of the assembler, upper and lower pairs of gear racks 702, with a pinion 703 mounted for rotation between each the racks. One of each of the pairs of racks 702 is connected to a vertical push bar 706, and the other corresponding rack is journalled for lateral translation. The right and left vertical push bars 706 are each connected to a pivot arm 708 which pivots on an index slide bar 710 which extends from a one end of the assembler frame to the other, between the pairs of indexer gear racks. A drive rod 712 is linked to vertical push bar 706 at the intersection of the push bar with the pivot arm. The drive rod 712 is linearly actuated by a cylinder 714, such as a hydraulic or pneumatic cylinder. Driving the rod 712 out from cylinder 714 moves the vertical push bar 706 and the attached racks 702. The translation of the racks 702 attached to the vertical push bar 706 causes rotation of the pinions 703 which induces translation in the opposite direction of the opposing rack 702 of the rack pairs.

Figure 10B:
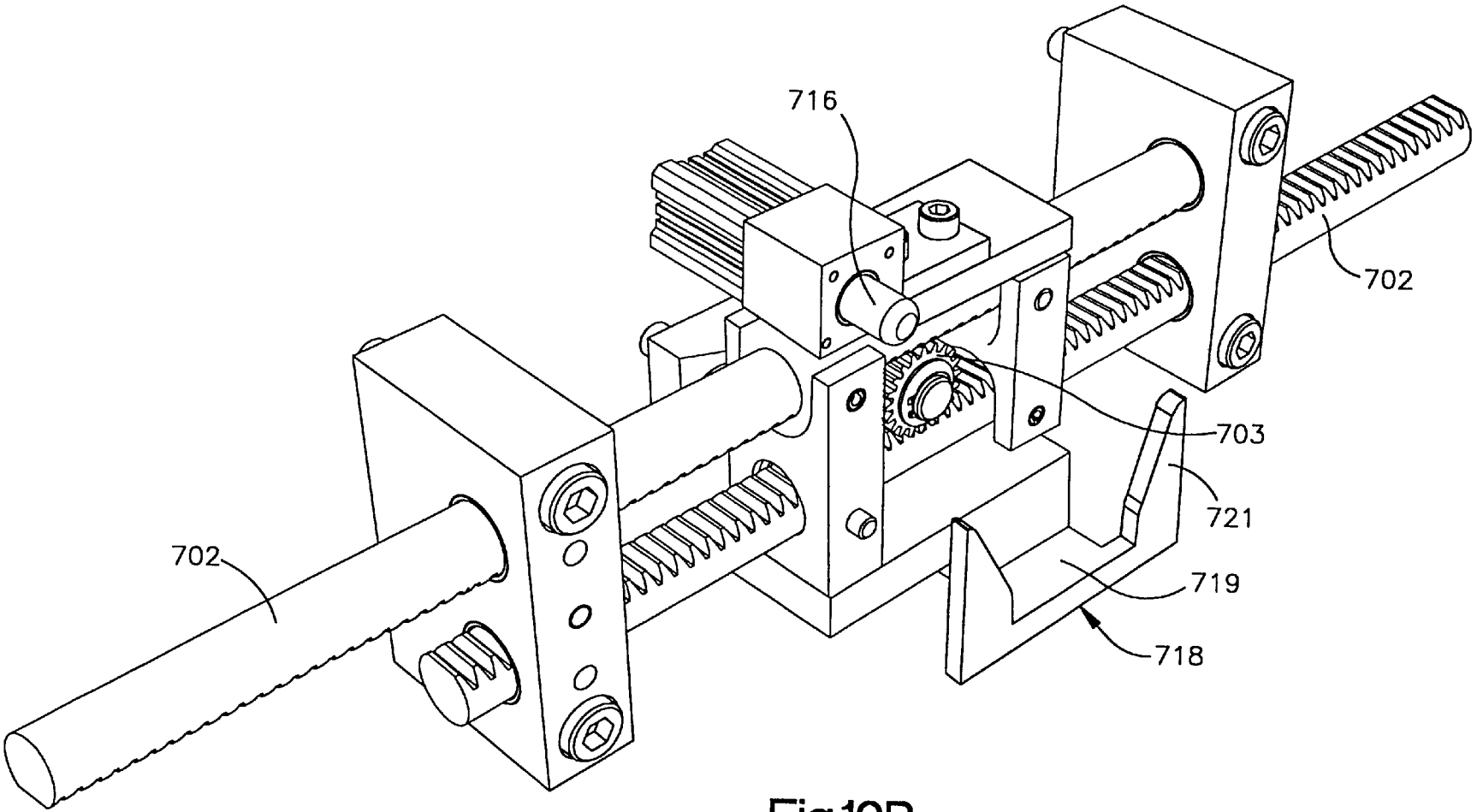
FIG. 10B is an isolated perspective view of an indexing subassembly of the innerspring assembly machine of FIG. 5.
Figure 11:
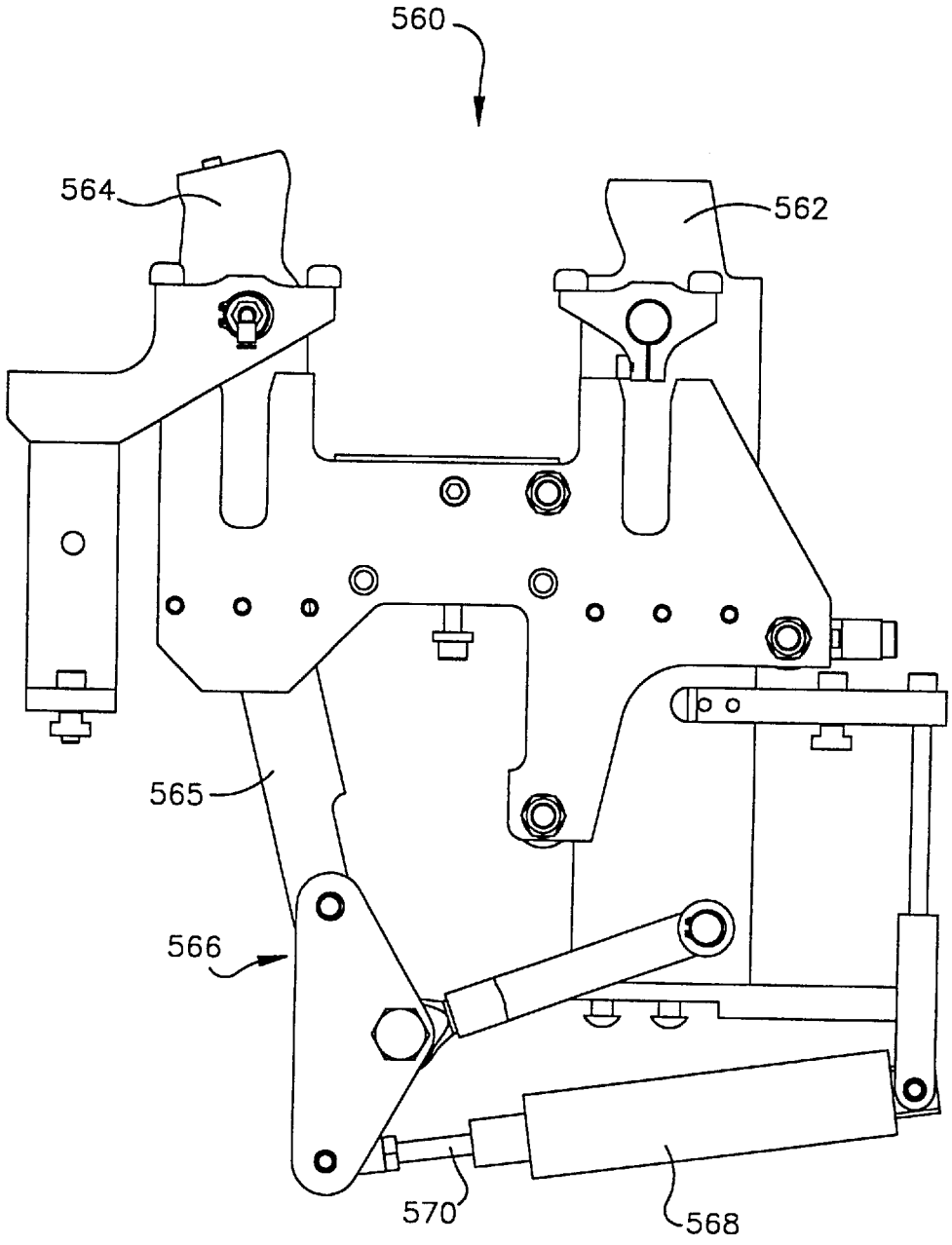
FIG. 11 is an isolated elevational view of a clamp subassembly of the innerspring assembly machine of FIG. 5.

As further shown in FIG. 10B, for each pair of racks 702, one of the racks 702 carries or is secured to a linearly actuatable pawl 716, dimensioned to fit within an axial bore at the end of a carrier bar 506 (not shown). The corresponding opposing rack 702 carries or is attached to a guide 718 having an opening with a flat surface 719 dimensioned to receive the width of a carrier bar 506, flanked by opposed upstanding tapered flanges 721. As shown in FIG. 10A, on the lower half of the assembler, the lower rack 702 of the opposed rack pairs carries a guide 718 in which a lower carrier bar 506B (not shown) is positioned. The opposed corresponding rack 702 carries pawl 716 engaged in an axial bore in lower carrier bar 506A (not shown). An opposite arrangement is provided with respect to the upper pairs of racks 702. With the carrier bars 506 thus in contact with the indexer assembly, linear actuation of the drive rods 712 causes the carrier bars 506A and 506B to horizontally translate in opposite directions and exchange vertical plane positions (i.e. to swap), to accomplish the process step previously described with reference to the FIG. 7I.

The innerspring assembler of the invention further includes a clamping mechanism operative to laterally compress together the adjacent pairs of dies 504A and 504B (or carrier bars 506) when they are horizontally aligned (as described with reference to FIG. 7D), so that the coils in the dies are securely held together as they are fastened together by, for example, a helical lacing wire. As shown in FIG. 5 (and schematically depicted in FIGS. 7A–7I), the innerspring assembler includes upper and lower back-up bars 550 which are horizontally aligned with the corresponding carrier bars 506 during the described inter-coil lacing operation. Each back-up bar 550 is intersected by or otherwise operatively connected to arms 562, 564 of a clamp assembly shown in FIG. 11. The clamp assembly 560 includes a fixed clamp arm 562, and a moving clamp arm 564, connected by linkage 566. A shaft 570 extending from a linear actuator 568, such as an air or hydraulic cylinder, is connected at a lower region to linkage 566. Extension of shaft 570 from actuator 568 causes the distal end 565 of the moving clamp arm 564 to laterally translate away from the adjacent carrier bar 506 to an unclamped position. Conversely, retraction of the shaft 570 into the actuator 568 causes the distal end 565 of the moving clamp arm 564 to move toward the adjacent carrier bar 506, clamping it against the horizontally adjacent carrier bar 506, and against the adjacent carrier bar 506 which backs up against the fixed clamp bar 562. The clamp assemblies 560 on the upper half of the assembler are mounted upon the assembler frame and does not move with the carrier bars and dies. The clamp assemblies 560 on the lower half of the assembler are mounted on the elevator bar 632B to move with the carrier bars. Thus by operation of actuator 568 the clamp assemblies either hold adjacent rows of dies/carrier bars tightly together, or release them to allow the described vertical and horizontal movements.

Figure 6A:
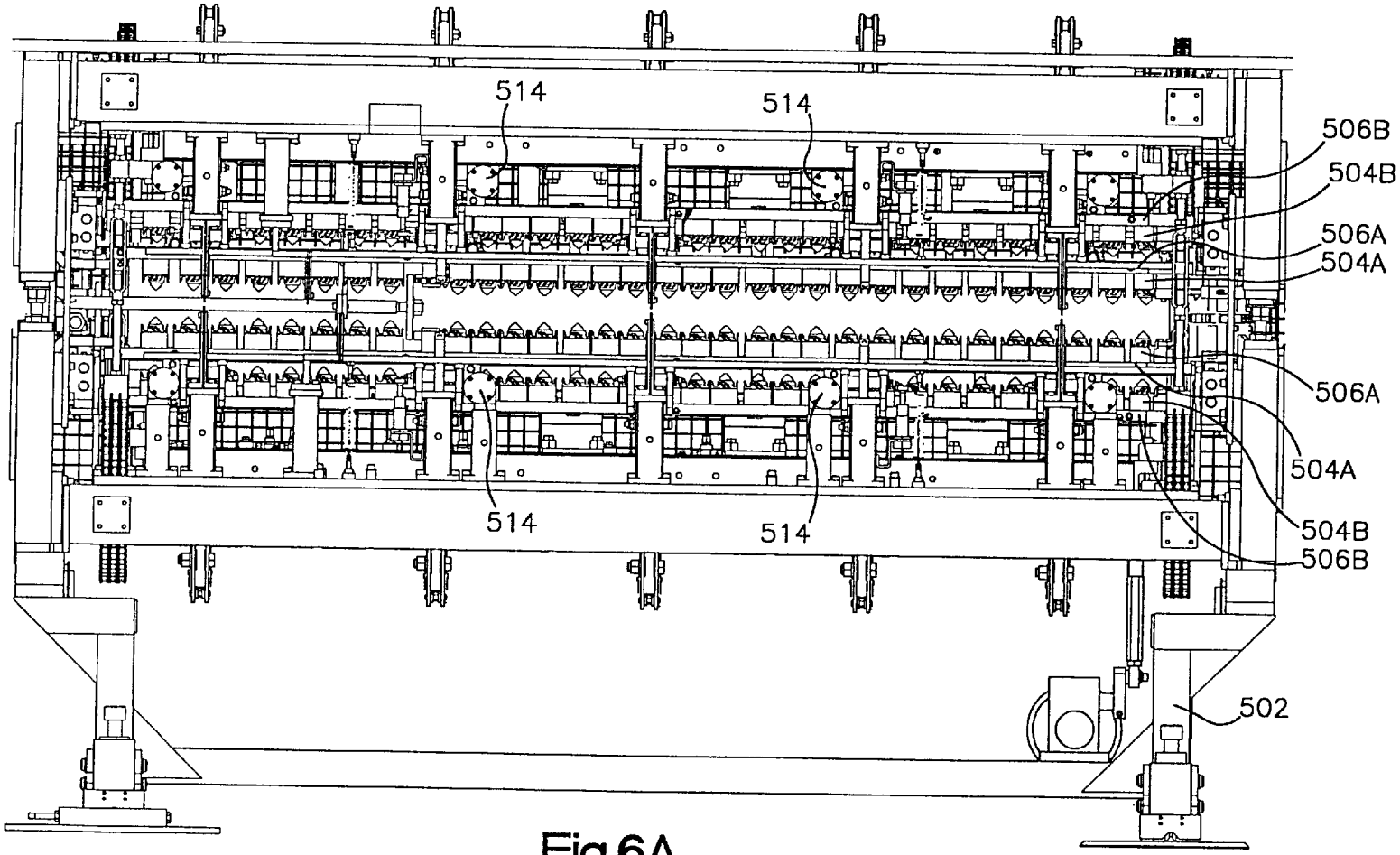
FIG. 6A is an elevation of the innerspring assembly machine of FIG. 5.
Figure 6B:
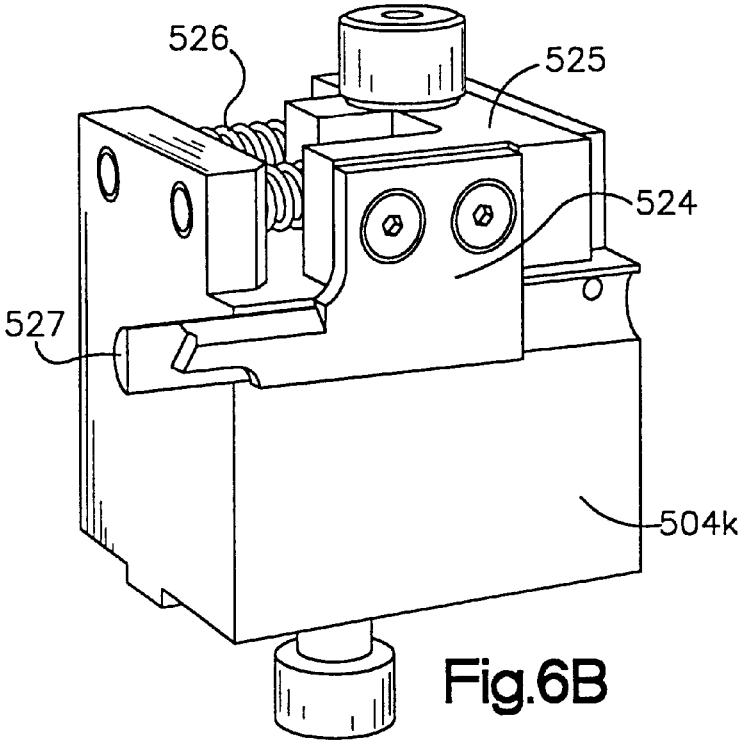
FIG. 6B is a perspective view of a knuckler die attachable to the innerspring assembler.

One or more of the dies 504 may be alternately configured to crimp and/or cut each of the helical lacing wires once it is fully engaged with two adjacent rows of coils. For example, as shown in FIG. 6B, a knuckler die 504K is attachable to a carrier bar at a selected location where the helical lacing wire is to be crimped or "knuckled" to secure it in place about the coils. The knuckler die 504K has a knuckle tool 524 mounted upon a slidable strike plate 525 which biased by springs 526 so that the tip 527 of the knuckle tool 524 extends beyond an edge of the die. In the assembler, a linear actuator (not shown) such as a pneumatically driven push rod, is operative to strike the strike plate 525 to advance the knuckle tool 524 in the path of the strike plate to bring the tool into contact with the lacing wire. Where upper and lower knucler dies 504K are installed on the upper and lower carrier bars of the assembler, the linear actuator is provided with a fitting which contacts both the upper and lower strike plates of the knuckler dies simultaneously.

Figure 17A:
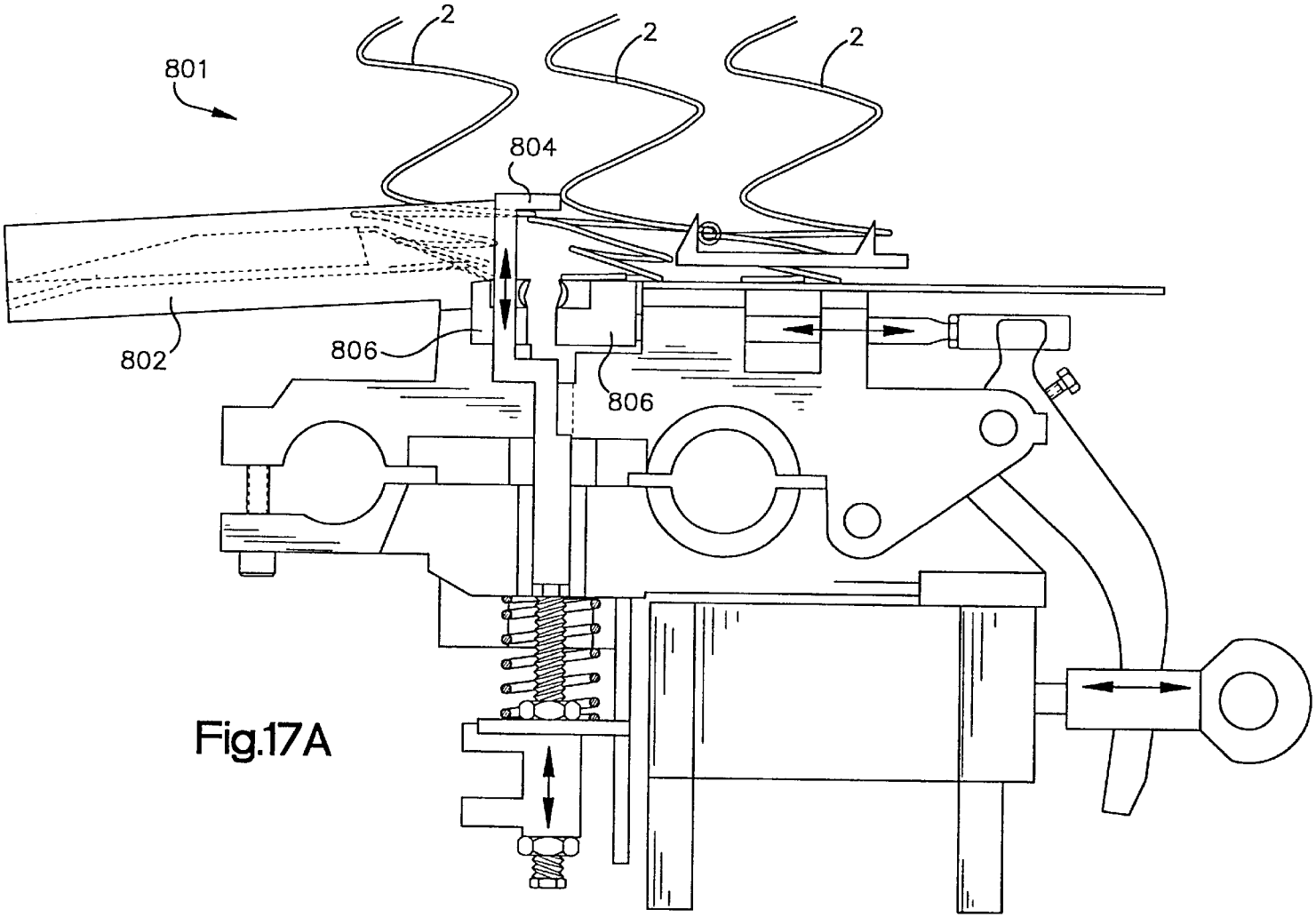
FIGS. 17A–17G are elevational views of an alternate coil connecting mechanism of the present invention.
Figure 17B:
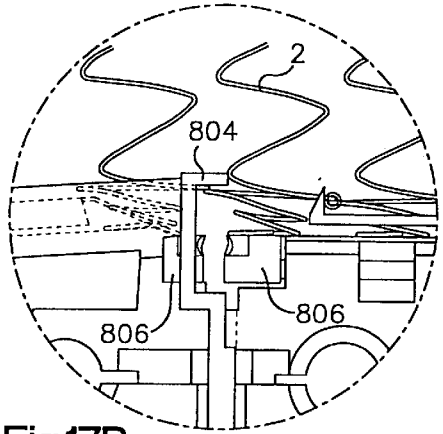
Figure 17C:
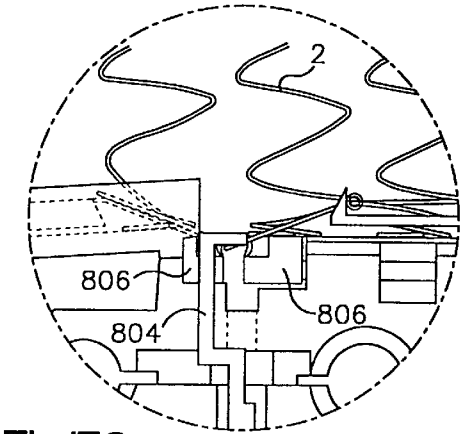
Figure 17D:
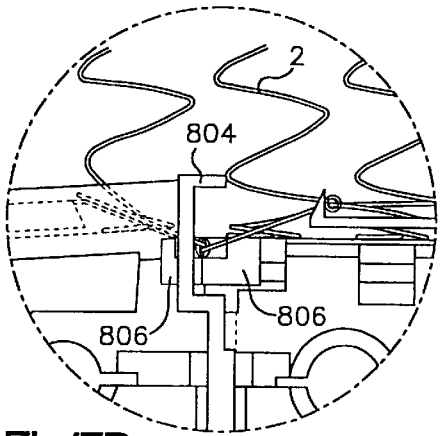
Figure 17E:
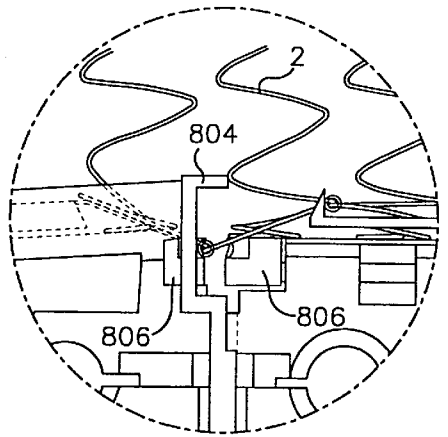
Figure 17F:
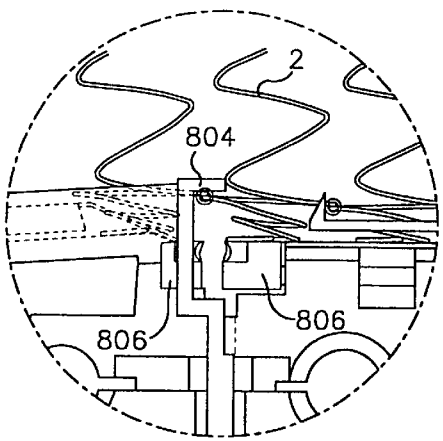
Figure 17G:
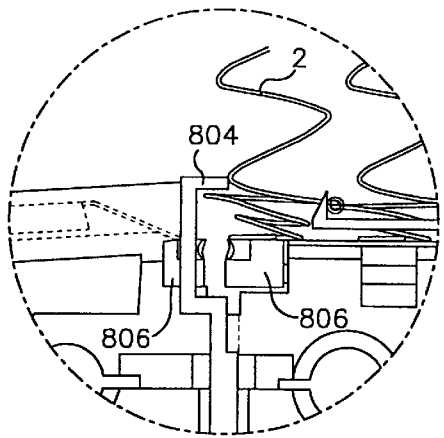

The invention further includes certain alternative means of lacing together rows of coils within the innerspring assembly machine. For example, as shown in FIGS. 17A–17G, lacer tooling 801 includes a guide ramp 802 upon which the terminal end of coils 2 are advanced into position by a finger 804 which positions the coil ends within partable tooling 806. As shown in FIG. 17C, the downward travel of the finger 804 positions segments of the adjacent coils heads within complementary tools 806 which then clamp to form a lacing channel for insertion of a helical lacing wire. Once laced together, the tools 806 part and the connected coils are advanced to allow for introduction of a subsequent row of coils. FIG. 17B illustrates a starting position, with the coil heads of a new row of coils at left and a preceding row of coils engaged by the finger 804. In FIG. 17C, the finger is actuated downward to draw the coil head segments in between the parted tools 806. In FIG. 17D, the finger 804 then returns upward as the coil heads are laced together within the tools 806 which are placed tightly together about overlapping segments of the adjacent coil heads. In FIG. 17E, the tools 806 open to release the now connected coils which recoil upward to contact finger 804 (as in FIG. 17F), and the connected coils are indexed or advanced to the right in FIG. 17G to allow for introduction of a subsequent row of coils.

Figure 18A:
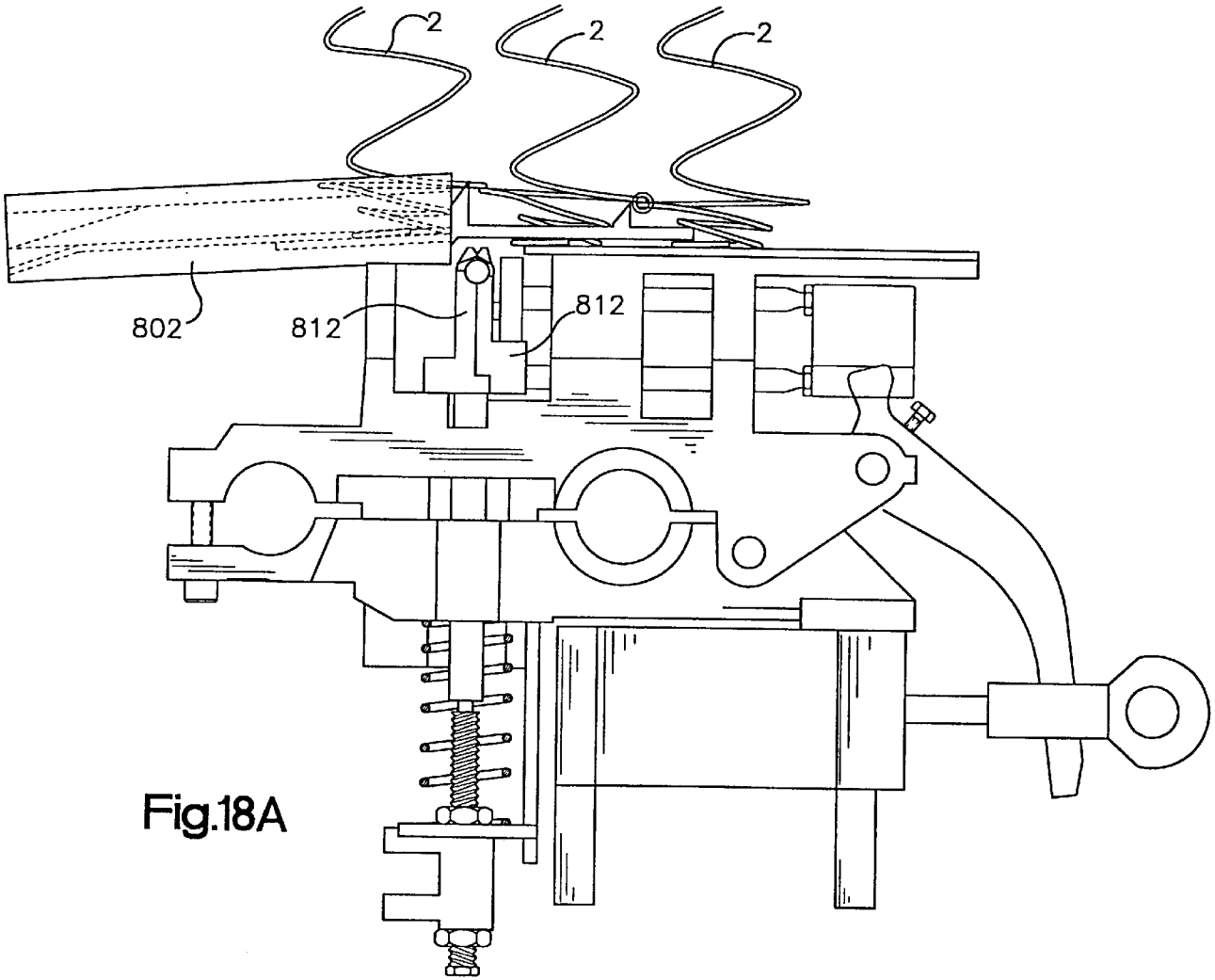
FIGS. 18A–18G are elevational views of an alternate coil connecting mechanism of the present invention.
Figure 18B:
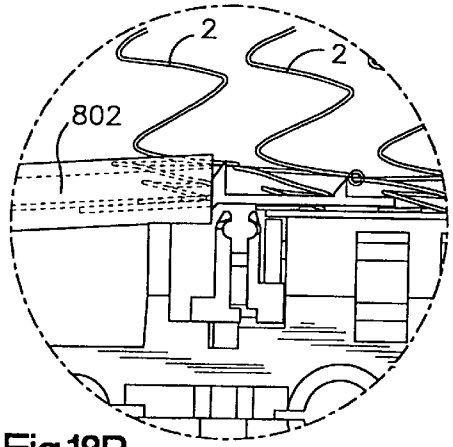
Figure 18C:
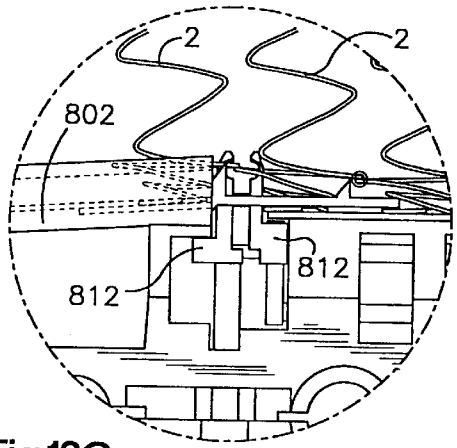
Figure 18D:
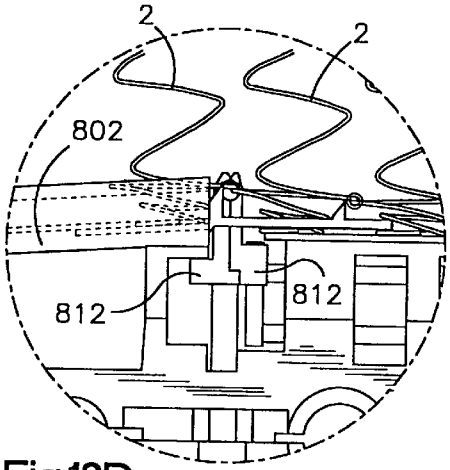
Figure 18E:
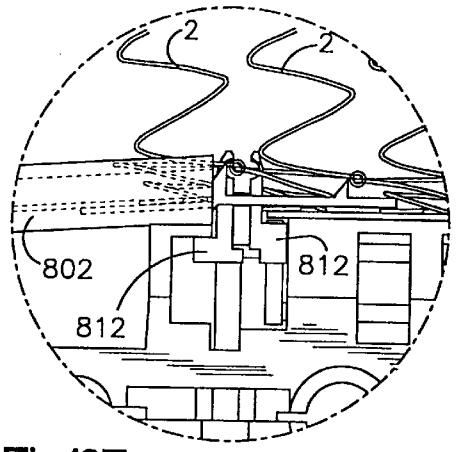
Figure 18F:
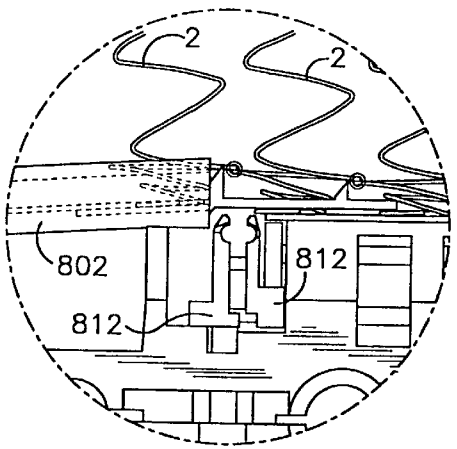
Figure 18G:
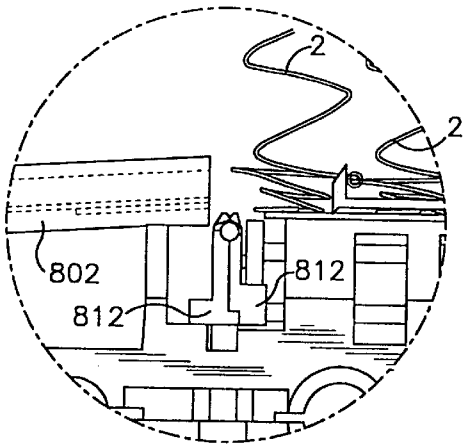

FIGS. 18A–18G illustrate still another alternative means and mechanism for lacing or otherwise connecting adjacent rows of coils. The coils are similarly advanced up a guide ramp 802 so that overlapping segments of adjacent coil heads are positioned directly over extendable tools 812. As shown in FIG. 18B, the tools 812 are laterally spread and, in FIG. 18C, extend vertically to straddle the overlapping coil segments, and clamp together thereabout as in FIG. 18D to securely hold the coils as they are laced together. The tools 812 then part and retract, as in FIGS. 18E and 18F, and the connected coils are indexed or advanced to the right in FIG. 18G and the process repeated.

Figures 19A, 19B, 19C:
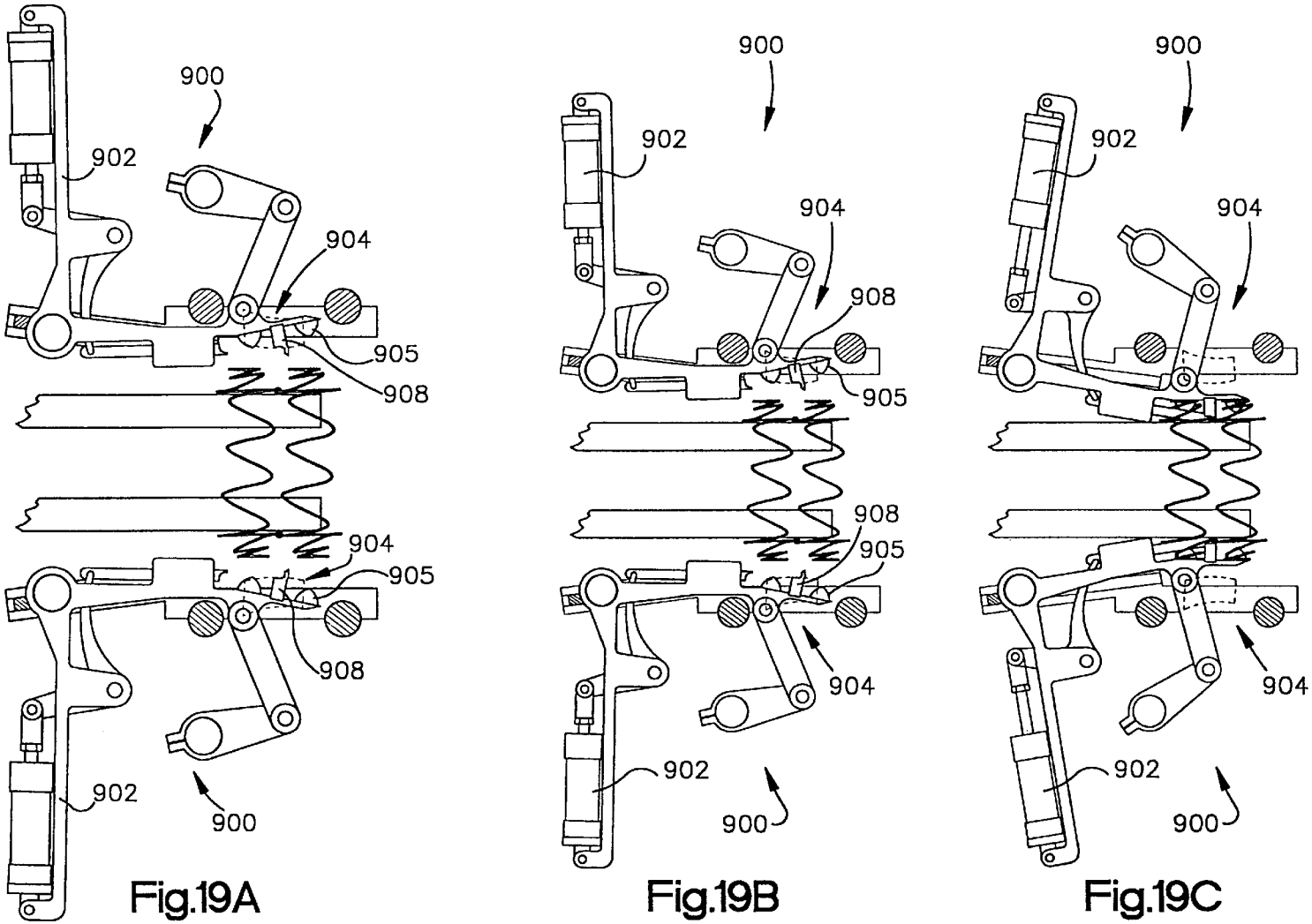
FIGS. 19A–19F are elevational views of an alternate coil connecting mechanism of the present invention.
Figure 19F:
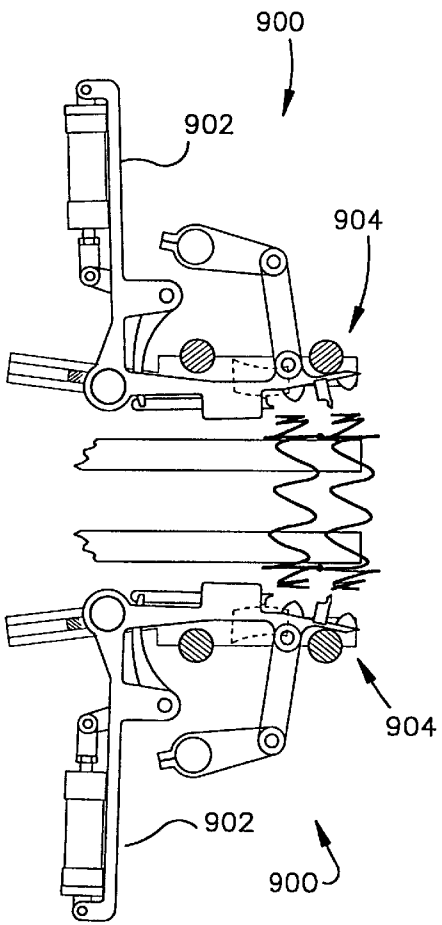
Figure 19E:
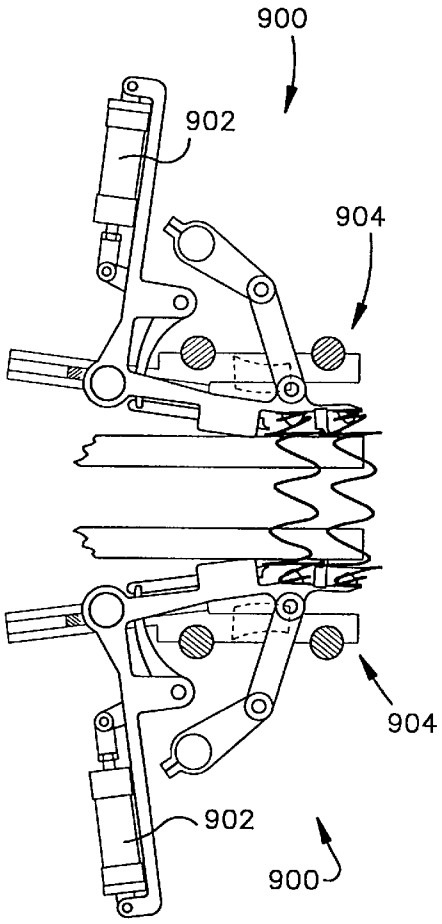
Figure 19D:
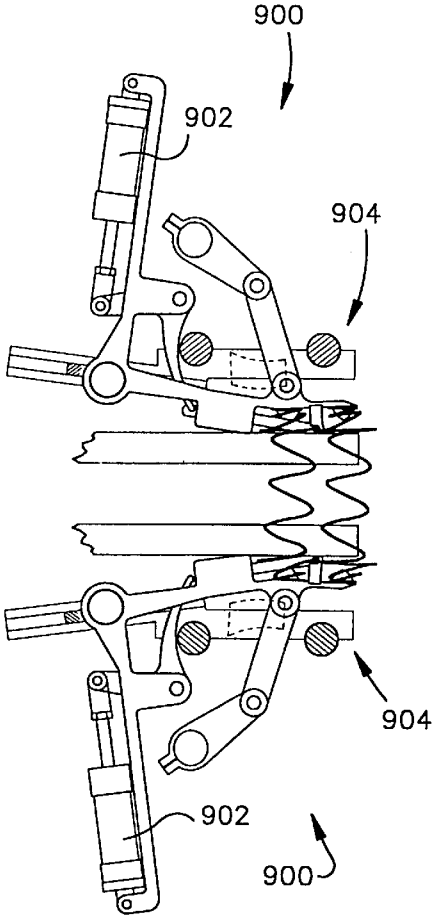

FIGS. 19A–19F illustrate still another mechanism or means for lacing or interconnecting adjacent coils. Within the innerspring assembler are provided a series of upper and lower walking beam assemblies, indicated generally at 900. Each assembly 900 includes an arm 902 which supports dual coil-engaging tooling 904, mounted to articulate via an actuator arm 906. The tooling 904 includes cone or dome shaped fittings 905 configured for insertion into the open axial ends of the terminal ends of the coils. This correctly positions a pair of coils between the upper and lower assemblies for engagement of lacing tools 908 with segments of the coil heads (as shown in FIG. 19C). Once the lacing or attachment is completed, the assemblies 900 are actuated to laterally advance the attached coils to the right as shown in FIG. 19D. The assemblies 900 then retract vertically off the ends of the coils, and then retract laterally (for example to the left in FIG. 19F to receive the next row of coils.

The coil formers, conveyors, coil transfer machine and innerspring assembler are run simultaneously and in synch as controlled by a statistical process control system, such as an Allen-Bradley SLC-504 programmed to coordinate the delivery of coils by the genevas to the conveyors, the speed and start/stop operation of the conveyors the interface of the arms of the coil transfer machine with coils on the conveyors, and the timed presentation of rows of coils to the innerspring assembler. and operation of the innerspring assembler.

Although the invention has been described with reference to certain preferred and alternate embodiments, it is understood that numerous modifications and variations to the different component could be made by those skilled in the art which are within the scope of the invention and equivalents.

What is claimed is:

1. A coil formation device for forming coils having a generally helical coil body, a non-helical coil head, and a terminal convolution generally smaller than the coil body, the coil formation device comprising:

a wire feed mechanism which feeds wire stock into a coil forming block, the coil forming block having a cavity within which a terminal convolution of the coil is formed, a coil radius forming wheel against which wire stock bears to form a generally helical shape to the coil body, a helical guide pin in contact with the wire stock and operative to move relative to the forming block to form a generally helical shape to the coil body, a wire cutting tool configured to cut the wire stock within the cavity of the coil forming block, a geneva for transferring a coil from the coil forming block to a coil head forming station, the coil head forming station having a coil head formation die, the coil head formation die having a cavity configured to receive a terminal convolution of the coil, and a flange proximate to the cavity about which an end turn of the coil body is positioned by the geneva, and at least one punch operative to strike the end turn of the coil body against the flange of the coil head formation die to form a coil head between the coil body and the terminal convolution.

2. The coil formation device of claim 1 wherein the wire feed mechanism feeds wire stock into an upper portion of the cavity in the coil forming block, and an interior of the coil forming block cavity has a helical guide surface.

3. The coil formation device of claim 1 wherein the helical guide pin is operative to extend into alignment with the cavity of the coil forming block.

4. The coil formation device of claim 1 wherein the wire cutting tool includes a movable cutting blade mounted outside of the coil forming block, and a stationary blade mounted in the coil forming block, the movable cutting blade operative to move relative to the stationary blade to cut the wire stock within the cavity of the coil forming block.

5. The coil formation device of claim 1 wherein the wire cutting tool is configured to cut the wire stock at the end of a terminal convolution of the coil at a point inside a diameter of the body of the coil which is greater than a diameter of the terminal convolution.

6. The coil formation device of claim 1 wherein the geneva is operative to engage the coil body and to remove the terminal convolution of the coil from the cavity in the coil forming block and insert the terminal convolution into the cavity of the coil head formation die at the coil head forming station.

7. The coil formation device of claim 1 wherein the coil head formation die has an opening through which the terminal convolution of the coil enters the cavity of the coil head formation die.

8. The coil formation device of claim 1 wherein the coil head formation die is a two part assembly.

9. The coil formation device of claim 1 wherein the coil head formation die includes flanges configured to fit within an end turn of a coil body proximate to a terminal convolution of the coil in the cavity of the coil head formation die.

10. The coil formation device of claim 1 wherein the coil head formation die has at least one flange with a side wall configured for operation with punch, whereby a segment of wire of a coil engaged with the coil head formation die is formed by the punch against the wire and the side wall of the flange.

11. The coil formation device of claim 10 wherein the at least one flange of the coil head formation die is proximate to the cavity, and the terminal convolution of a coil engaged with the coil head formation die is connected to the end turn of the coil body by a segment of wire which traverses the flange.

12. The coil formation device of claim 1 wherein the coil head formation die is configured so that an end turn of the coil body of a coil engaged with the die is located near an intersection of the flange and a surface of the die.

13. A coil formation die for use with a coil former machine, the coil former machine having a wire feed mechanism for feeding wire stock from which coils are formed, a coil forming wheel against which wire stock is fed to form the wire into a coiled configuration, a helical guide pin operative to move the wire relative to the coil forming wheel to form a helix in the coiled wire, and a cutting device for cutting a formed coil from the wire stock, the coil formation die being attached to the coil former machine at a wire stock feed point and proximate to the coil forming wheel, the helical guide pin, and the cutting device, the coil formation die having a body with a wire stock feed hole through which wire stock is passed, and a cavity proximate to the wire stock feed point whereby at least a portion of the wire stock can be formed by the coil forming wheel in the cavity.

14. The coil formation die of claim 13 wherein a surface of the cavity against which the wire stock bears is tapered in a helical configuration.

15. The coil formation die of claim 14 wherein the taper in the cavity is congruent with a helix angle formed in the wire stock by the helical guide pin.

16. The coil formation die of claim 11 wherein a stationary blade of the cutting device is mounted within the cavity.

17. The coil formation die of claim 11 wherein a movable blade of the cutting device is operative to extend into the cavity.

18. The coil formation die of claim 11 wherein the helical guide pin is operative to engage wire stock formed within the cavity.

19. The coil formation die of claim 11 wherein the coil forming wheel is generally aligned with the cavity.

20. The coil formation die of claim 11 wherein the helical guide pin contacts only a body portion of the coil and does not contact the wire stock in the cavity.

21. The coil formation die of claim 11 wherein the wire stock feed point is near a top area of the cavity.

22. The coil formation die of claim 11 in the general configuration of a block attachable to a coil forming machine, and the cavity formed at one end of the block.

23. The coil formation die of claim 11 in combination with a coil forming machine for forming helical coils with at least one terminal convolution smaller than a body of the coil, wherein the coil formation die is selected according to a size or configuration of the cavity of the die to form the terminal convolution of the coil.

24. A coil head formation die for use with a coil forming machine for forming a coil head in an end turn of a body of a coil having a terminal convolution contiguous with a body of the coil, the coil head formed by operation of one or more punches of the coil forming machine operative to strike a portion of the end turn of the coil against the die while the end turn of the coil and the terminal convolution of the coil are engaged with the coil head formation die, the coil head formation die having a cavity configured to receive a terminal convolution of the coil, and a portion configured to oppose a punch which strikes the end turn of the coil to form a coil head.

25. The coil head formation die of claim 24 comprising a body having a back wall and side walls which extend from the back wall to form the cavity, and at least one flange which extends from a side wall, the flange configured to oppose a punch operative to strike an end turn of a coil proximate to the flange.

26. The coil head formation die of claim 24 having a back wall and side walls which define a cavity, and an opening in the side walls through which a terminal convolution of a coil can enter the cavity.

27. The coil head formation die of claim 24 combination with a coil forming machine having a back wall and side wall which define a cavity, an opening to the cavity generally opposite the back wall, and a compression plate attached to the coil formation machine proximate to the coil head formation die, the compression plate positioned to at least partially compress a coil prior to engagement of a portion of the coil with the cavity in the coil head formation die.

28. The coil head formation die of claim 24 in combination with a coil having a terminal convolution positioned within the cavity of the die, wherein the terminal convolution is at least partially compressed within the cavity.

29. The coil head formation die of claim 25 having at least one flange proximate to the cavity.

30. The coil head formation die of claim 27 wherein a body of the die is in two parts.

31. The coil head formation die of claim 25 in combination with a coil forming machine having a coil formation station, and at least one coil head formation station, and a geneva for carrying coils between the stations, wherein the cavity of the coil head formation die at the coil head formation station has an opening oriented in a direction of travel of a coil carried by the geneva.

32. A coil formation die for forming a generally helical wire coil with helix of different diameter at different sections of the coil, the coil formation die comprising a die body having a guide wire stock guide through which wire stock is fed to a wire stock exit point to contact a coil forming wheel of a coil forming machine, a cavity in the die body proximate to the wire stock exit point, the cavity having an arcuate configuration against which a portion of the wire stock is formed by the coil forming wheel, and the cavity being positioned relative to a wire cutting device of the coil forming machine so that a formed coil can be cut from the wire stock within the cavity.

33. A coil head formation die for use with a coil forming machine having a coil head formation station at which a coil is positioned for formation of a coil head by operation of one or more punches on a turn of the coil, the coil head formation die having a die body attachable to the coil head formation station, the die body having a back wall and side sections which extend from the back wall, the back wall and side sections defining a cavity for receiving a portion of a coil, and a punch striking structure for positioning a portion of the coil to be struck by a punch to form a coil head.

34. A coil head formation die for forming a coil head in a turn of a generally helical coil having a terminal convolution with a diameter different than a diameter of a body of the coil, the coil head formation die having a die body with a rear wall and side walls which define a cavity for receiving a terminal convolution of a coil, a portion of the die body positionable adjacent to a turn of a coil engaged with the die and against which a punch can operate to form one or more bends in the turn of the coil proximate to the terminal convolution.

35. A coil formation die for use with a coil forming machine for forming a generally helical wire spring coil of varying diameter, the coil formation die having die body and a wire stock guide in the die body through which wire stock is fed to a wire stock exit point past which the wire stock contacts a coil forming wheel of the coil forming machine to coil the wire stock at varying diameters, a cavity in the die body proximate to the wire stock exit point, the cavity having a generally arcuate surface against which at least a portion of the wire is formed by the coil forming wheel.

* * * * *

UNITED STATES PATENT AND TRADEMARK OFFICE

CERTIFICATE OF CORRECTION

PATENT NO. : 6,640,836 B1
DATED : November 4, 2003
INVENTOR(S) : Larry DeMoss et al.

It is certified that error appears in the above-identified patent and that said Letters Patent is hereby corrected as shown below:

Title page,
Item [75], Inventors, should read as follows:
-- Larry DeMoss, Jamestown, NC; Joe Zhou, Brunswick, OH; Thomas D. Haubert, Columbus, OH; Jan B. Yates, Reynoldsburg, OH --.

Signed and Sealed this

Twenty-third Day of August, 2005

JON W. DUDAS
*Director of the United States Patent and Trademark Office*